United States Patent [19]

Evans

[11] 4,361,195

[45] Nov. 30, 1982

[54] DOUBLE ACTING HYDRAULIC MECHANISM

[76] Inventor: Robert W. Evans, 7126 Brookstone, Houston, Tex. 77040

[21] Appl. No.: 214,454

[22] Filed: Dec. 8, 1980

[51] Int. Cl.[3] ..... E21B 4/14

[52] U.S. Cl. ..... 175/297; 166/178; 175/299

[58] Field of Search ..... 166/178; 175/296, 297, 175/299

[56] References Cited

U.S. PATENT DOCUMENTS

| | | | |
|---|---|---|---|
| 2,499,695 | 3/1950 | Storm | 175/297 |
| 2,551,868 | 5/1951 | Brady | 175/297 |
| 2,659,576 | 11/1953 | Linney | 175/297 |
| 2,989,132 | 6/1961 | Downen | 175/297 |
| 4,059,167 | 11/1977 | Berryman | 175/297 |
| 4,109,736 | 8/1978 | Webb et al. | 175/297 |
| 4,226,289 | 10/1980 | Webb et al. | 175/297 |

*Primary Examiner*—Stephen J. Novosad
*Attorney, Agent, or Firm*—Neal J. Mosely

[57] ABSTRACT

A double acting hydraulic drilling mechanism, i.e. drilling jar, is disclosed for use in a tubular drilling string for applying upward or downward jarring forces for dislodging a "fish" from a well. The jar is adapted to be run into a well on a drill string and connected to a fishing tool in the well bore. This jar comprises outer and inner housing members positioned in telescoping relation for longitudinal movement of one relative to the other and having a hammer member on one and an anvil member on the other. The housing members enclose a chamber adapted to contain a fluid for controlling application of jarring forces. A pair of pistons are positioned in spaced relation for movement of each relative to the other in the hydraulic fluid chamber. The pistons are arranged so that movement of one housing relative to the other in one direction will move the first piston toward the second and movement in the opposite direction will move the second piston toward the first. The chamber between the pistons has an outlet controlled by a suitable valve member. Valve actuating means are provided which are operated upon predetermined relative movement of the housing members in either direction to open the valve to permit flow of fluid from the fluid chamber to substantially eliminate the resistance to further movement of the housing members and thus permit movement of a hammer member into engagement with an anvil member with an impact force. An alternate embodiment utilizes one or both pistons in a dash-pot action in lieu of the valve member permitting fluid flow from the fluid chamber.

35 Claims, 26 Drawing Figures

FIG 1-a
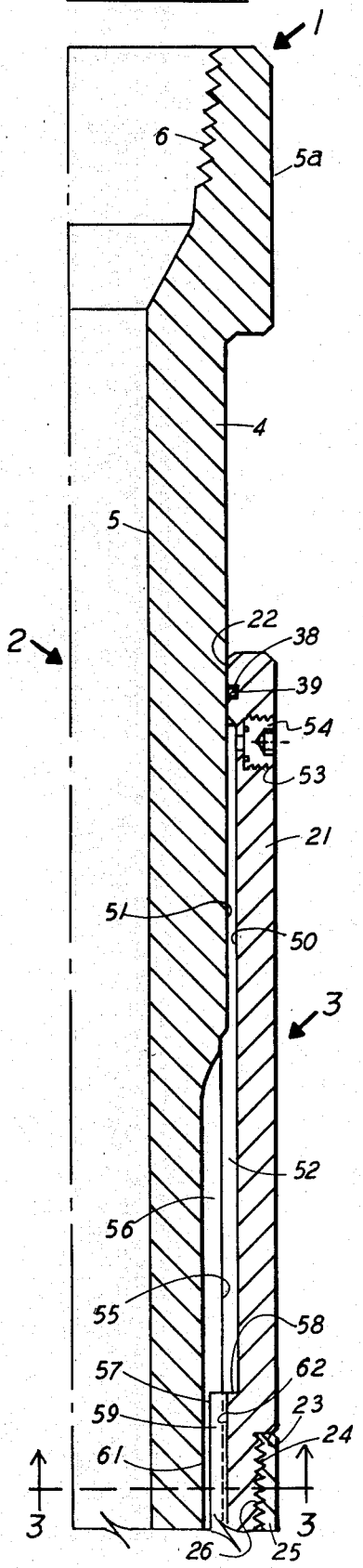
FIG. 1-b
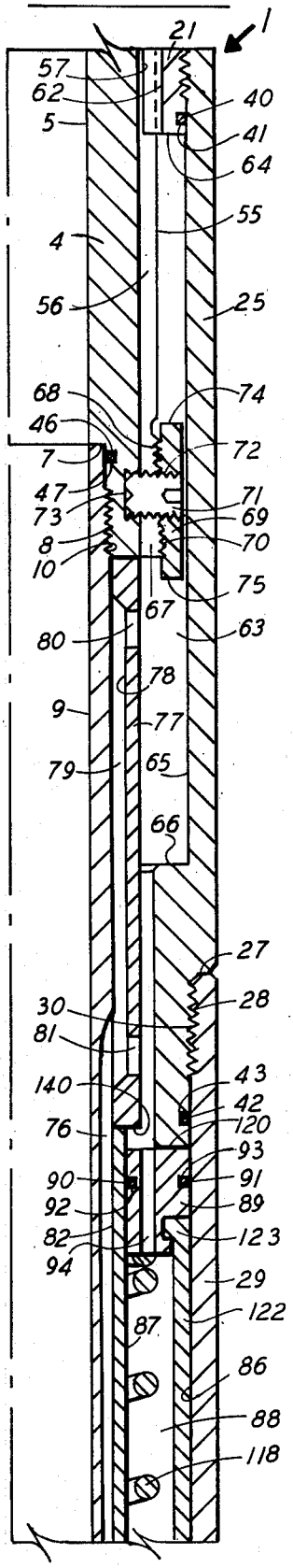
FIG. 1-c
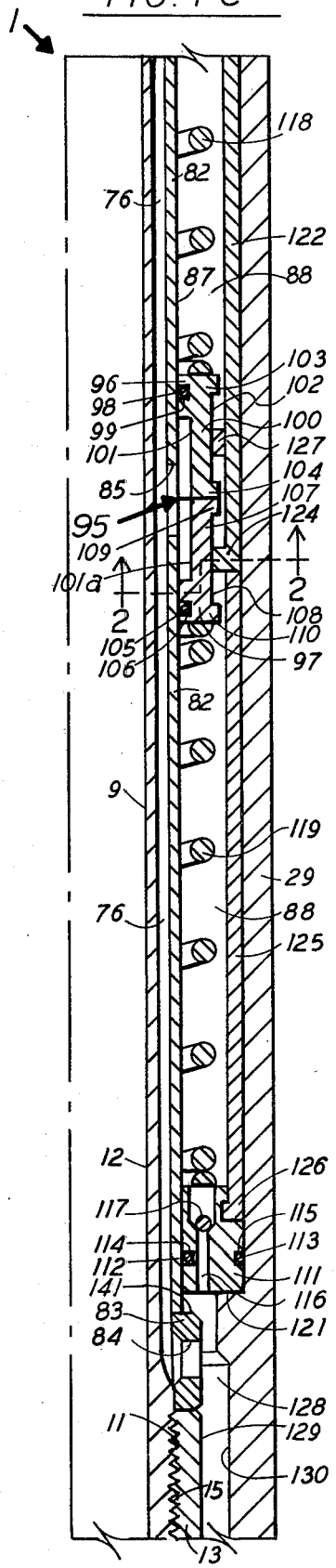

FIG. 1-d
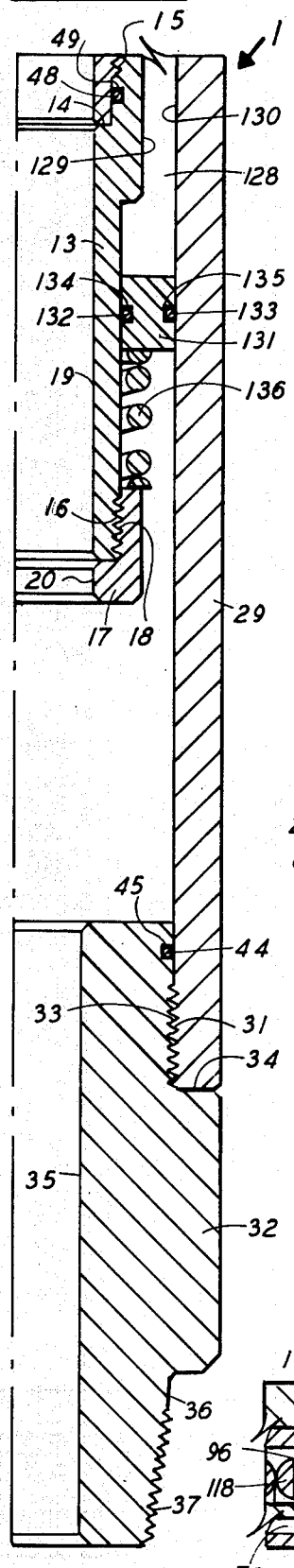
FIG. 2
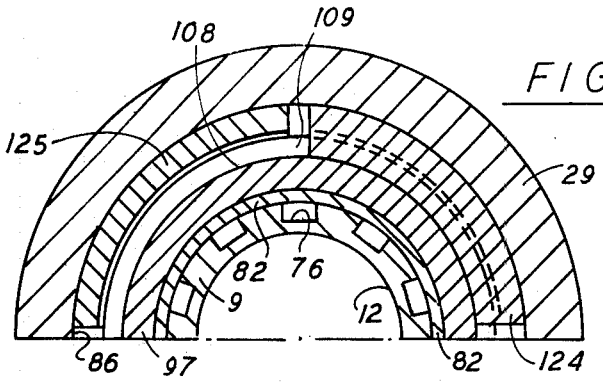
FIG. 3
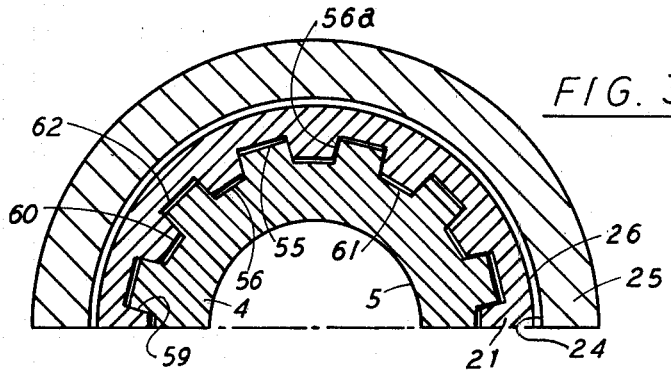
FIG. 4
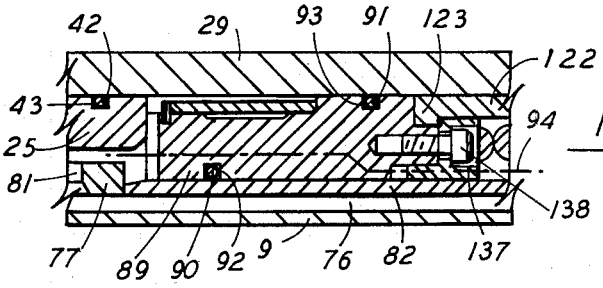
FIG. 5
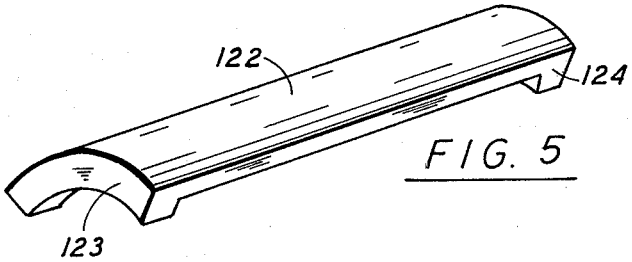
FIG. 6
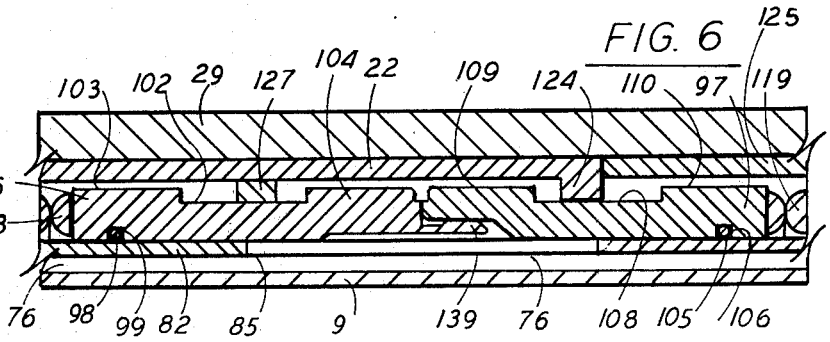

FIG. 7-a
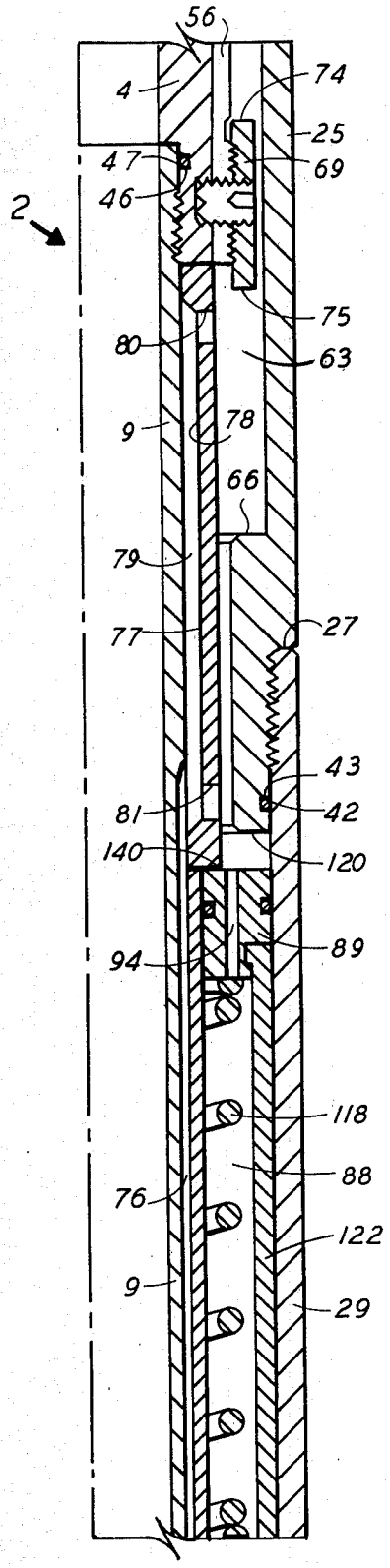
FIG. 7-b
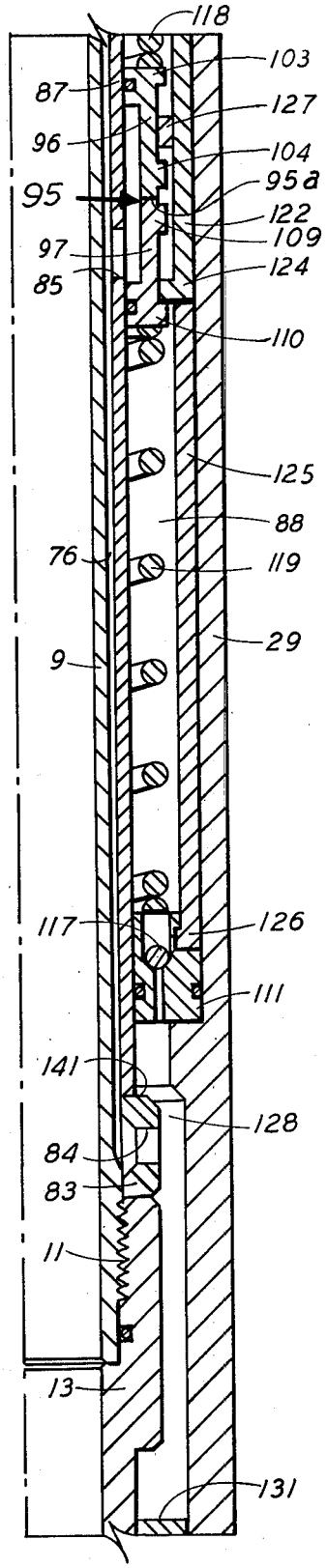

FIG. 8
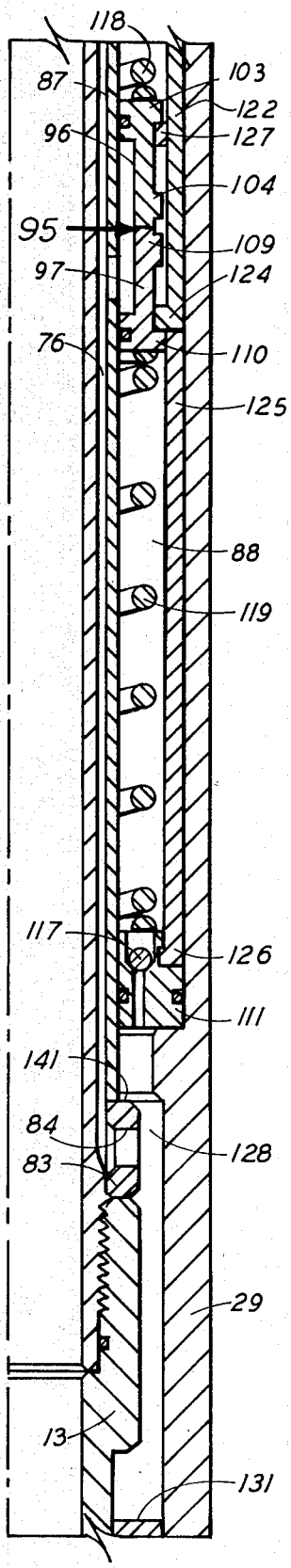
FIG. 9-a
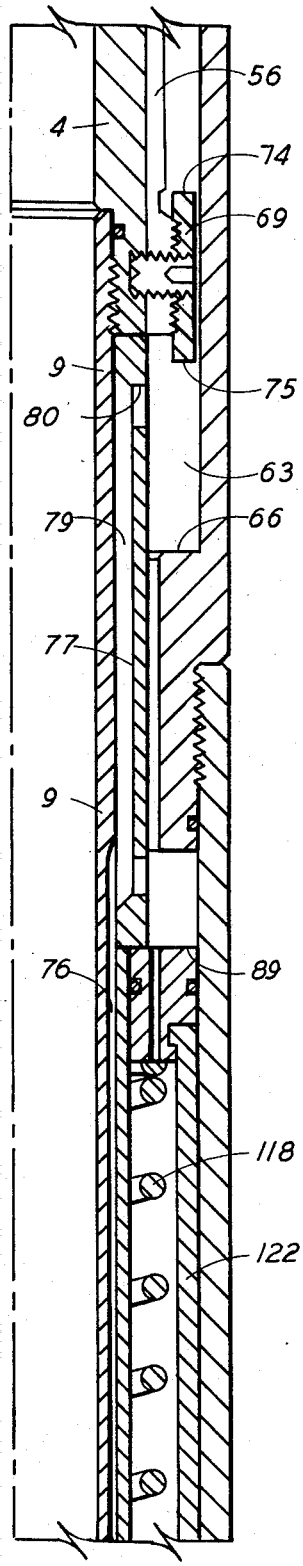
FIG. 9-b
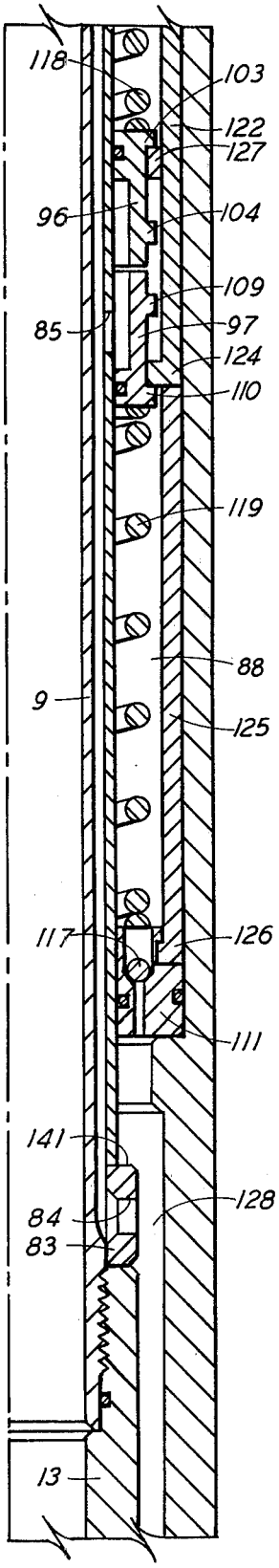

FIG. 10-a
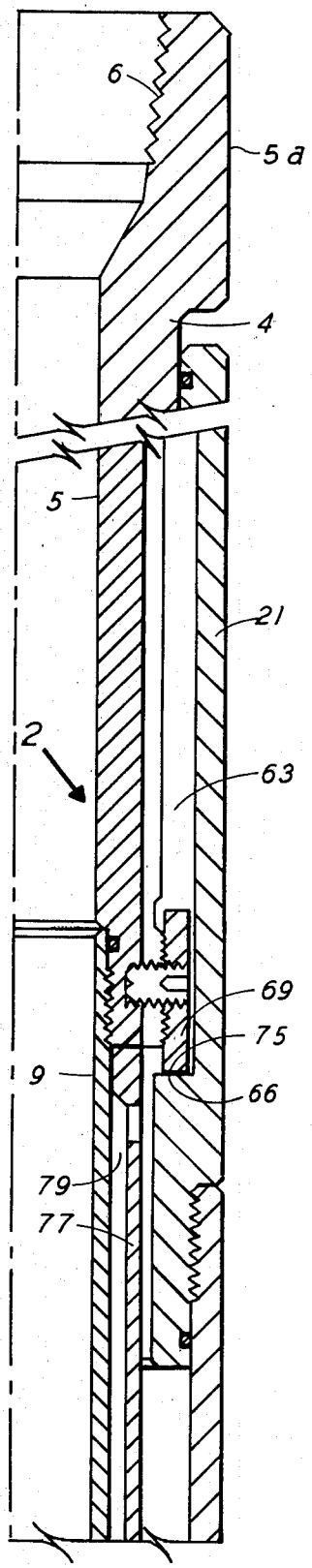
FIG. 10-b
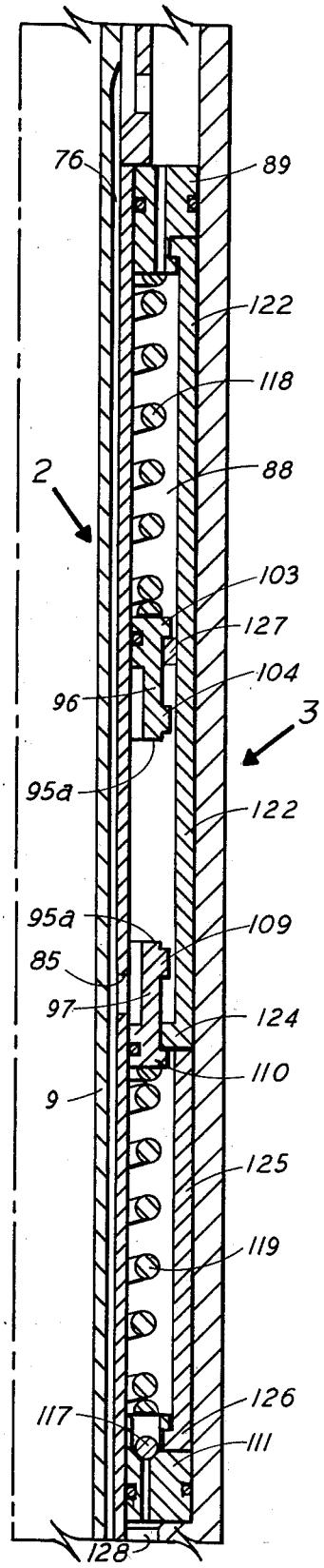

FIG. 11-a
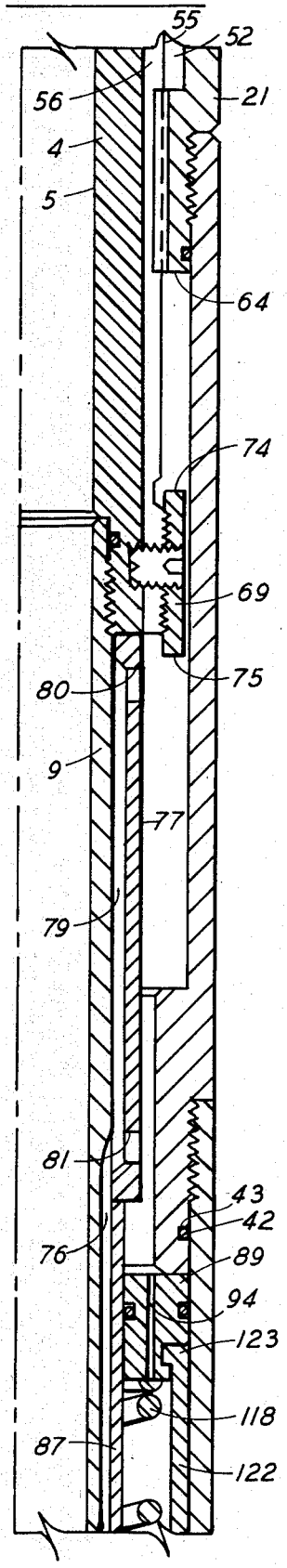
FIG. 11-b
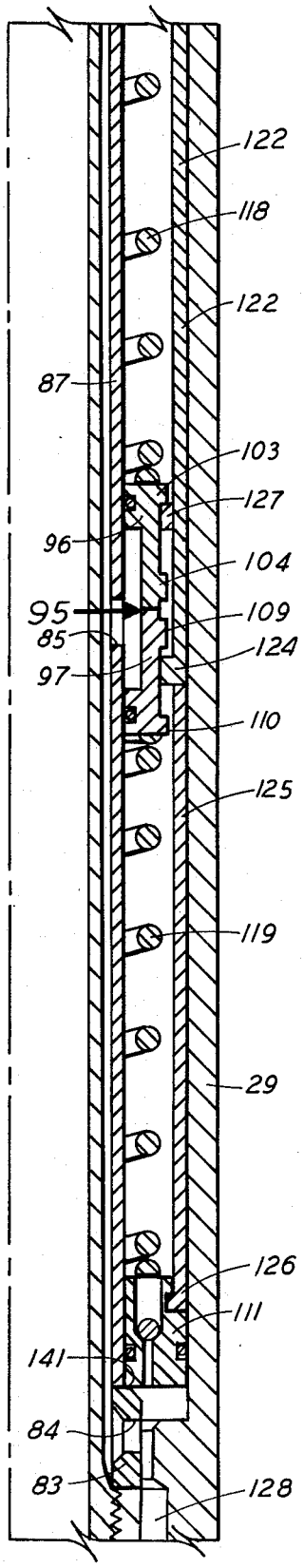
FIG. 12-a
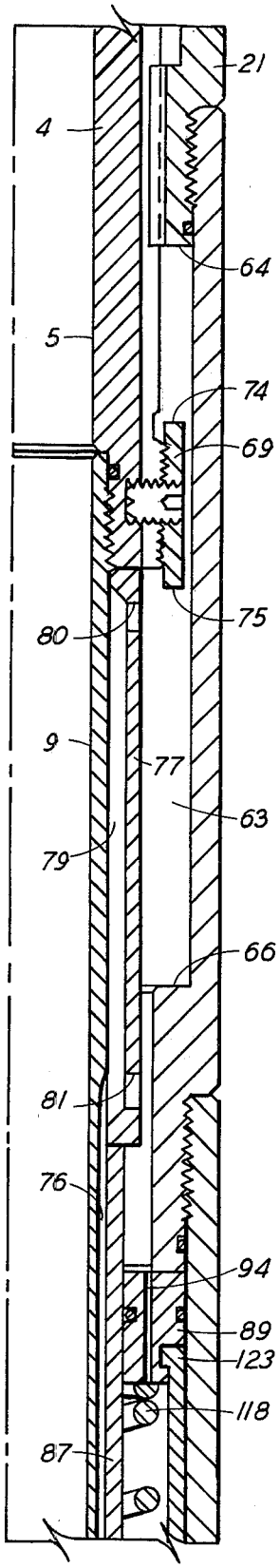

FIG. 12-b
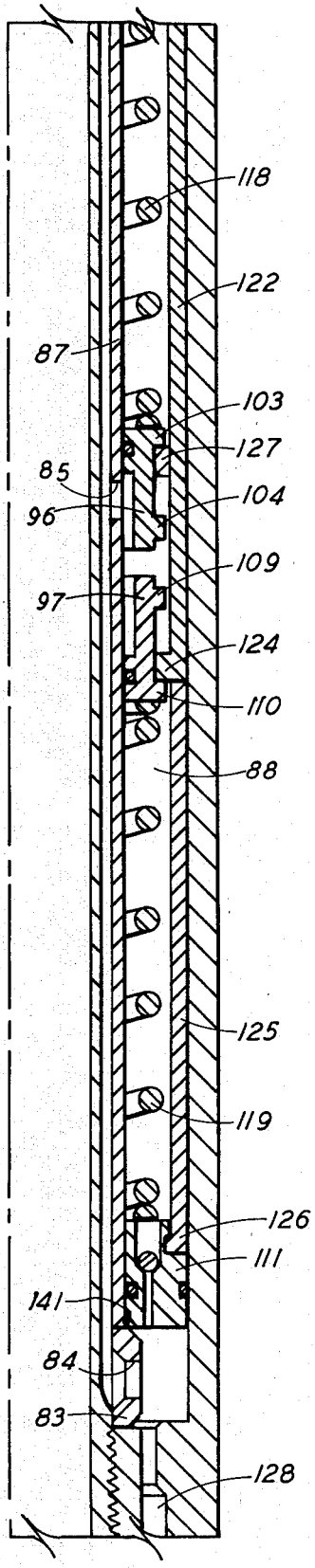
FIG. 13-a
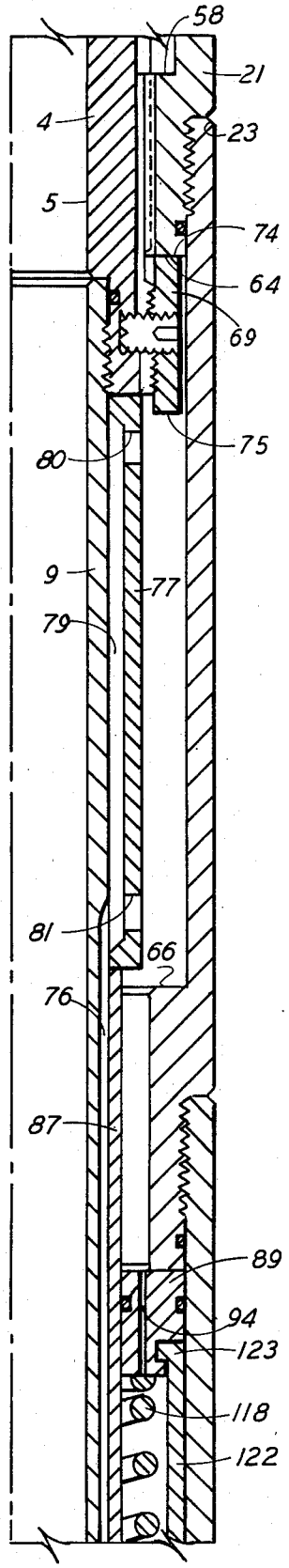
FIG - 13-b
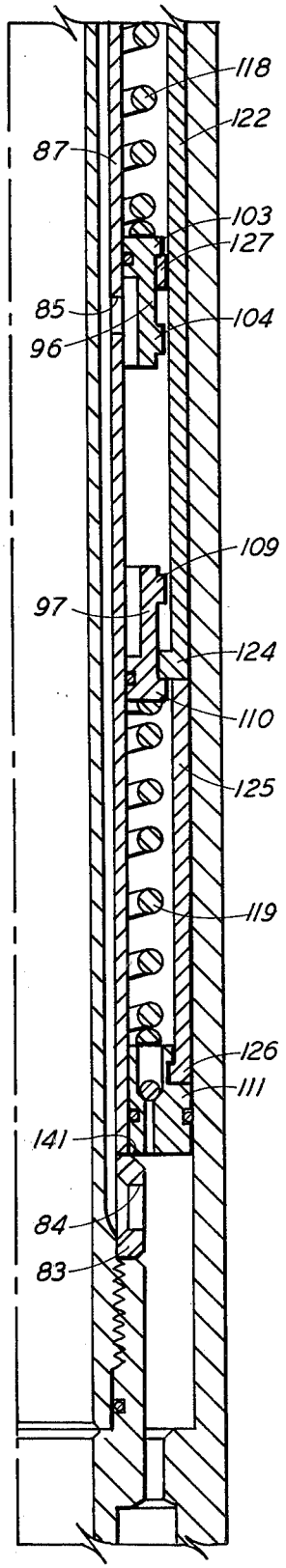

DOUBLE ACTING HYDRAULIC MECHANISM

BACKGROUND OF THE INVENTION

1. Field of the Invention

This invention relates to new and useful improvements in drilling jars and more particularly to double acting hydraulic drilling jars and the like.

2. Brief Description of the Prior Art

A fishing job, in oilfield terminology, means removing something from the well bore that does not belong there. What is removed is called a "fish" and may be part of a drilling string which has become stuck when drilling an oil or gas well, or may be production equipment being removed from an existing well bore during a workover or repair operation. The accepted method of retreiving a fish is to grab it by some means and push or pull an axial strain on it until something gives. A jar is a tool employed when either drilling or production equipment has become stuck to such a degree that a straight push or pull from the surface is insufficient to dislodge it.

The jar is normally placed in the pipe string in the region of the stuck object and allows the drilling rig operator at the surface to deliver an impact blow at the fish through manipulation of the drill pipe string. Jars contain a spline joint which allows relative axial movement between an inner mandrel or housing and an outer housing without allowing relative rotational movement. The mandrel or inner housing contains an impact surface or hammer, which contacts a similar impact surface or anvil on the housing when the jar has reached the limit of axial travel. If these impact surfaces are brought together at high velocity, they transmit a very substantial impact to the fish due to the mass of the pipe above the jar.

Prior art jars are of three distinct forms, viz. hydraulic jars, mechanical jars and bumper jars. The bumper jar is used primarily to provide a downwardly directed impact blow. The bumper jar is usually a splined joint with sufficient axial travel allowed so that the pipe can be lifted and dropped, causing the impact surfaces inside the jar to come together to deliver a downward impact blow to the fish. Mechanical and hydraulic jars differ from the bumper jar in that they contain a tripping mechanism which retards the motion of the impact surfaces relative to each other until an axial strain, either tension or compression, has been applied to the pipe. To jar upward, the pipe is stretched by an axial tensile pull applied at the surface. This tensile force is resisted by the tripping mechanism of the jar long enough to allow the pipe to stretch and store potential energy. When the jar "trips", this stored energy is converted to kinetic energy causing the impact surfaces of the jar to move together at a high velocity. To jar downward, the pipe weight is "slacked off" at the surface to put the pipe in compression. This compressive force is resisted by the tripping mechanism of the jar to allow the pipe to compress and store potential energy. When the jar "trips", the potential energy of pipe compression and pipe weight is converted to kinetic energy causing the impact surfaces of the jar to come together at a high velocity. Hydraulic and mechanical jars are much more efficient than bumper jars because they allow a much greater impact at the fish for a given pipe strain.

Most fishing jobs require that both an upward and downward jar be available in the fishing string. For example, during the drilling of an oil or gas well, the pipe may become stuck due to hole sloughing or differential pressure sticking such that it would be desirable to jar the pipe upward. Or the pipe might become lodged in a keyseat while "tripping" (removing the pipe from the well bore—do not confuse with tripping the jar) in which case it would be desirable to jar downward on the stuck point. Another example occurs when fishing for production equipment such as packers or pumps. Normally the tubing or rod above the stuck point is cut off and the fishing string is attached to the tubing or rod left in the bore by means of an overshot. A series of upward blows is initiated to attempt to dislodge the fish. If the fish can not be dislodged readily from the well bore, it becomes necessary to deliver a downward impact to the overshot in order to release it from the tubing or rod.

Various combinations of jars are used to achieve this two direction jarring action. A mechanical or hydraulic jar may be double acting such that it jars both up and down. Or an up jarring tool may be run with a separate down jarring tool. Whether combined into the same tool or embodied into separate tools, the jar must operate in either direction independently of the other to be fully effective and efficient. That is, the tool should trip in one direction, recock and trip in the same direction again without inadvertently, or of necessity, tripping in the opposite direction. Also, the recocking of the tripping mechanism in one direction should not be retarded by the tripping mechanism in the opposite direction.

Mechanical jars are generally less versatile and reliable than hydraulic jars. One design of mechanical tripping mechanism requires that the tripping load be selected and preset at the surface to trip at one specific load. If it is desired to increase or decrease the tripping load, it is necessary to pull the pipe from the well bore, a costly and time consuming procedure. Another mechanical tripping mechanism of known configuration requires that torque be applied from the surface through the pipe to the tripping mechanism and that this torque be maintained while the jar trips. This can be dangerous to personnel on the rig floor and makes the tripping load difficult to control in deviated well bores. Another weakness of mechanical tripping devices is that they must be run in the cocked or detent position. Thus, the tripping mechanism is subjected to stresses during the normal course of drilling if it is run as a part of the bottom hole assembly. Mechanical tripping mechanisms have the additional disadvantage that the metallic parts must move relative to each other while under a high compressive load. This causes rapid wear and frequent failure of the moving parts.

Hydraulic tripping mechanisms are more desirable because they afford the versatility of a variable hitting load controlled only by the amount of axial strain applied at the surface. Also, hydraulic tripping mechanisms are less subject to mechanical deformation and wear than mechanical tripping mechanisms and therefore will work for a longer time under the same conditions. However, present hydraulic tripping mechanisms operate in one direction only and require two tripping mechanisms to be run in tandem in order to achieve a double acting jar function. This requires two separate hydraulic fluid chambers, two valve systems, two metering systems, and sufficient axial travel to operate either mechanism independently. The result is a long and expensive tool with long splines and seal surfaces.

The patent literature disclosing drilling jars has developed largely within the last thirty years.

Storm U.S. Pat. No. Re. 23,354 discloses a very early form of double acting hydraulic jar. This jar utilizes the dashpot principle with a piston section moving through a cylinder of reduced diameter so that flow of hydraulic fluid is restrained from flowing from one side of the piston to the other. This drilling jar has the disadvantage that it must be fully operated in one direction in order to reset it to operate in the opposite direction.

Chenoweth U.S. Pat. No. 3,349,858 discloses a single acting (upward) hydraulic drilling jar in which the oil flow through the piston is controlled by a constant flow regulator valve.

Berryman U.S. Pat. No. 3,735,827 discloses a hydraulic fishing jar requiring a compressible hydraulic fluid. The mandrel is moved until the hydraulic fluid is compressed to a selected degree at which point a control valve engeges an adjustable tripping abutment which opens the valve and dumps the pressurized fluid through a bypass to permit rapid movement of the hammer relative to the anvil surface.

Berryman U.S. Pat. No. 3,797,591 discloses a hydraulic fishing jar similar to U.S. Pat. No. 3,735,827 but including a different adjustable trigger mechanism.

Berryman U.S. Pat. No. 3,851,717 discloses a hydraulic fishing jar having a constant flow bypass for a tripping piston and arranged so that the tripping piston is moved down until the main bypass valve is opened and the device trips.

Berryman U.S. Pat. No. 4,059,167 discloses a fishing jar similar to Berryman '717 and incorporating a tandem piston arrangement to lower the internal operating pressure.

Young U.S. Pat. No. 3,285,353 discloses a fishing jar having telescoping mandrels, one connected to the drill string and the other to the drill fish, surrounded by an outer housing. A piston valve is arranged to dump pressure after a selected degree of movement and to move the housing to impact a hammer surface against an anvil surface.

Hazen U.S. Pat. No. 3,087,559 discloses a hydraulic fishing jar having mechanical trip fingers with a hydraulic delay.

SUMMARY OF THE INVENTION

One of the objects of this invention is to provide a new and improved drilling jar useful in earth drilling operations for removing stuck objects or "fish" from a drill hole or for assisting in drilling through hard fromations.

Another object of this invention is to provide a new and improved hydraulically controlled and actuated drilling jar which is double acting and thus capable of applying jarring forces in either an upward or downward direction.

Still another object of this invention is to provide a new and improved hydraulically controlled drilling jar in which the jar may operate upward or downward independently of the previous direction of operation.

Another object of this invention is to provide a new and improved double acting hydraulic drilling jar which can be recocked and operated again in the same direction, or in the opposite direction, as desired.

Still another object of this invention is to provide a new and improved double acting hydraulic drilling jar utilizing a single hydraulic chamber for jarring upward or downward.

Other objects of this invention will become apparent from time to time throughout the specification and claims as hereinafter related.

A new and improved double acting hydraulic drilling jar which achieves the above stated objectives uses a single hydraulic chamber for jarring in an upward or downward direction. The hydraulic chamber has a separate pressure piston at each end and is arranged so that either piston may be moved by the mandrel relative to the other piston, depending upon the direction in which the jar is to take place. A valve is positioned in the hydraulic chamber at about the mid point and controls the release of hydraulic fluid to permit rapid movement of the mandrel relative to the housing to cause a hammer to impact against a relatively stationary anvil.

When jarring upward, the mandrel moves the lower pressure piston upward to pressurize the hydraulic fluid while the upper piston remains stationary with the housing. When jarring downward, the upper piston moves with the mandrel while the lower piston remains stationary with the housing. The movement of the one piston toward the other is accomplished either by a slow controlled leakage of fluid from the chamber or by the use of a compressible hydraulic fluid. Tripping occurs when the mandrel has moved far enough relative to the housing in either direction to open the tripping valve in the hydraulic chamber. The tripping valve is spring biased to a normally closed position and floats between two sets of control arms. One set of control arms extends from the upper pressure piston to the lower half of the tripping valve and the other set of control arms extends from the lower piston to the upper half of the tripping valve. As one of the pistons is moved relative to the other to pressurize the hydraulic fluid, movement is restricted by the hydraulic pressure in the chamber and the fluid is metered from the chamber slowly through a flow metering passage. When a compressible fluid is used, the fluid metering passage is not needed and may be eliminated. When one piston has moved a sufficient distance relative to the other, its control arm contacts its half of the tripping valve and, after sufficient further movement, moves half of the tripping valve relative to the other to cause the valve to open and permit the fluid to exhaust rapidly from the chamber and permit rapid movement of the piston and the mandrel, causing the hammer carried on the mandrel to impact rapidly against the stationary anvil located on the housing.

Reverse movement of the mandrel relative to the housing causes the apparatus to recock into a neutral position from which it can be operated to provide a jarring motion in either an upward or downward direction, as desired. The apparatus also includes means for controlling the flow through the separate pistons in a manner such that the time delay for tripping in one direction may be different from that in the opposite direction.

In an alternate embodiment of the invention, the tripping valve arrangement is eliminated and the hydraulic chamber is enlarged in its mid-portion so that the movement of one piston relative to the other functions as a dashpot with the fluid being released when the piston reaches the enlarged portion of the chamber.

BRIEF DESCRIPTION OF THE DRAWINGS

FIGS. 1*a*–1*d* are successive portions, in quarter section, along the length of a double acting hydraulic drilling jar showing a preferred embodiment of this invention in a neutral position.

FIG. 2 is a view in half cross section of the drilling jar taken on the section line 2—2 of FIG. 1c.

FIG. 3 is a view in half cross section of the drilling jar taken on the section line 3—3 of FIG. 1a.

FIG. 4 is an enlarged detail sectional view of the pressure piston shown in FIG. 1b.

FIG. 5 is an isometric view of one of the actuating arms interconnecting the pressure piston and the tripping valve, as seen in FIGS. 1b and 1c.

FIG. 6 is an enlarged detail sectional view of the tripping valve shown in FIG. 1c.

FIGS. 7a–10b show the apparatus in successive stages of the down stroke for jarring in the downward direction.

FIGS. 7a and 7b show approximately the portion of the apparatus shown in FIGS. 1b and 1c with the mandrel moved partially downward inside the outer housing.

FIG. 8 corresponds approximately to FIG. 1c of the drawing with the mandrel moved to a point just prior to opening the tripping valve.

FIGS. 9a and 9b correspond substantially to FIGS. 1b and 1c just after the tripping valve has been opened.

FIGS. 10a and 10b correspond to the position of the apparatus after the tripping valve has been opened and the mandrel has moved to the fully actuated position with the hammer striking the anvil portion thereof.

FIGS. 11a–13b illustrate the apparatus at various stages of an upstroke for jarring in an upward direction.

FIGS. 11a and 11b show the apparatus on upward movement of the mandrel just prior to opening of the tripping valve.

FIGS. 12a and 12b illustrate the further upward movement of the mandrel just past the point of opening of the tripping valve.

FIGS. 13a and 13b illustrate the apparatus with the tripping valve fully opened and the mandrel moved to its maximum upward position with the hammer engaging the anvil portion thereof.

DESCRIPTION OF A PREFERRED EMBODIMENT

Figure 14A:
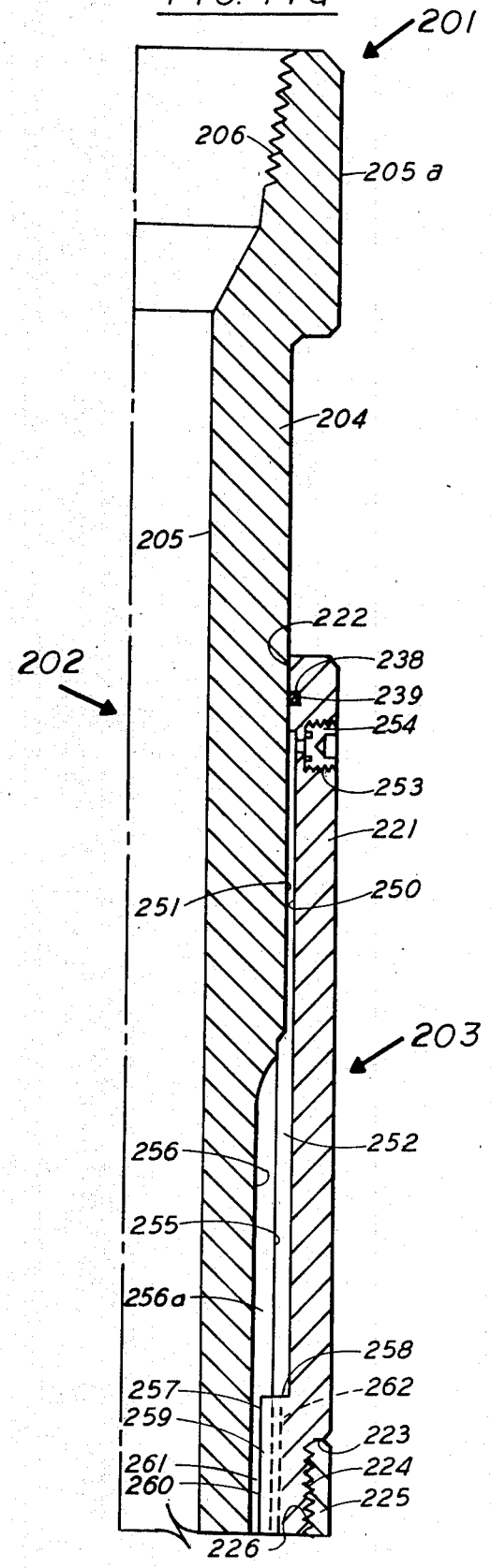
FIGS. 14a–14d are successive portions, in quarter section, along the length of a double acting hydraulic drilling jar showing an alternate embodiment of this invention, requiring no tripping valves, in a neutral position.

Referring to the drawings, and particularly to FIGS. 1a–1d, inclusive, there is shown a double acting hydraulic mechanism or drilling jar 1 which is of substantial length necessitating that it be shown in four longitudinally broken quarter sectional views, viz. FIGS. 1a, 1b, 1c and 1d. Each of these views is shown in longitudinal section extending from the center line of the jar to the outer periphery thereof. Drilling jar 1 comprises inner tubular mandrel 2 telescopingly supported inside outer tubular housing 3. Mandrel 2 and housing 3 each consist of a plurality of segments or parts which must be described in further detail.

Mandrel 2 consists of an upper tubular portion 4 (in FIGS. 1a and 1b) having an inner longitudinal passage 5 extending therethrough. The upper end of upper portion 4 is enlarged as indicated at 5a and is internally threaded at 6 for connection to a drill string or the like. The lower end of mandrel portion 4 is provided with a counterbore ending in internal shoulder 7 and internally threaded as indicated at 8. An intermediate portion of mandrel 2 consists of tubular sleeve member 9 (in FIGS. 1b and 1c) which has its upper end threaded as indicated at 10 for connection inside threaded portion 8 of member 4 with the upper end portion abutting shoulder 7. The lower end of sleeve member 9 is threaded externally as indicated at 11 and is provided with an internal bore or passage 12 which is a continuation of passage 5 in mandrel portion 4. The lower end of mandrel 2 consists of tubular member 13 (in FIGS. 1c and 1d) which is provided with a counterbore ending in shoulder 14 and internally threaded as indicated at 15. Tubular portion 13 is threadedly assembled on the lower end of tubular member 9 with the lower end thereof abutting shoulder 14.

The lower end portion of tubular member 13 is internally threaded as indicated at 16. A sleeve member 17 having internal threads 18 is threadedly secured on the lower end of tubular member 13 for supporting a spring which will be subsequently described. Tubular portion 13 is provided with an internal longitudinal passage 19 which is an extension of passages 5 and 12 and opens through the central opening 20 of sleeve member 17. The three portions 4, 9 and 13 are threadedly assembled, as shown, into a single tubular mandrel 2 which is longitudinally movable inside tubular housing 3 as will be subsequently described.

Tubular housing 3 is formed in several sections, for purposes of assembly, somewhat similarly to mandrel 2. The upper end of tubular housing 3 consists of tubular member 21 (in FIGS. 1a and 1b) which has a smooth inner bore 22 at its upper end in which the exterior surface of upper mandrel tubular member 4 is positioned for longitudinal sliding movement. The lower end portion of tubular housing member 21 has a portion of reduced diameter forming an annular shoulder 23 and having an exterior threaded portion 24.

Tubular housing 3 is provided with an intermediate tubular portion 25 (in FIGS. 1a and 1b) which is internally threaded as indicated at 26 at its upper end for threaded connection to the threaded portion 24 of tubular housing member 21. The upper end of the intermediate tubular portion 25 abuts shoulder 23 when the threaded connection is made up tight. The lower end portion of tubular member 25 has a portion of reduced diameter forming shoulder 27 and externally threaded as indicated at 28.

The lower portion of tubular housing 3 consists of tubular member 29 (in FIGS. 1b, 1c and 1d) which is internally threaded as indicated at 30 at its upper end for threaded connection to the threaded portion 28 of intermediate housing portion 25. The upper end of the lower tubular housing portion 29 abuts shoulder 27 when the threaded connection is made up tight. The lower end of tubular housing portion 29 is internally threaded as indicated at 31 (in FIG. 1d).

At the lower end of tubular housing 2, there is provided a tubular connecting member or sub 32 which is externally threaded, as indicated at 33, at its upper end and has a shoulder 34 against which the lower end of tubular housing member 29 abuts when the threaded connection 31/33 is made up tight. Connection sub 32 has an inner longitudinal passage 35 which is a continuation of the passages through mandrel 2. The lower end of sub 32 is of reduced diameter as indicated at 36 and provided with an externally threaded surface 37 for connection into the lower portion of a drill string or for connection to a fish, or the like, when the apparatus is used as a fishing jar.

As has already been noted, the mandrel 2 and housing 3 are each formed of several threadedly connected sections for purposes of assembly. Mandrel 2 is arranged for sliding movement inside housing 3. The apparatus will be charged with a suitable operating fluid, e.g. hydraulic fluid, as will be subsequently described, and it is therefore necessary to provide seals against leakage from several points of assembly and also from the points of sliding engagement between mandrel 2 and housing 3.

As previously noted, the exterior surface of the upper mandrel portion 4 has a sliding fit in the bore 22 of the upper tubular portion 21 of housing 3. Tubular member 21 is provided with an internal annular groove 38 in which there is positioned an O-ring 39 which seals that sliding joint against leakage of hydraulic fluid. The threaded connection between tubular housing portions 21 and 25 is sealed against leakage by an O-ring 40 (in FIG. 1*b*) which is positioned in external peripheral groove 41 in the lower end of tubular housing member 21. The threaded connection between tubular housing members 25 and 29 is similarly sealed against fluid leakage by an O-ring 42 (in FIG. 1*b*) which is positioned in peripheral groove 43 in the lower end portion of housing member 25. The threaded connection between the lower end of tubular housing member 29 and connecting sub 32 is similarly sealed against leakage of fluid by O-ring 44 (in FIG. 1*d*) positioned in annular groove 45 in the upper end of sub 32. Similar seals are provided to prevent leakage through the threaded joints connecting the several sections of mandrel 2. The threaded connection between upper tubular portion 4 and intermediate tubular portion 9 of mandrel 2 is sealed against leakage by O-ring 46 (in FIG. 1*b*) which is positioned in inner annular groove 47 in the lower end portion of the upper tubular mandrel member 4. The threaded connection between intermediate tubular mandrel member 9 and lower tubular mandrel member 13 is similarly sealed against leakage by O-ring 48 (in FIG. 1*d*) which is positioned in inner circumferential groove 49.

The space between the inner bore of the various components of housing 3 and the external surface of mandrel 2 provides an enclosed chamber and passages for flow of hydraulic fluid (or other suitable operating fluid) through this drilling jar. Various additional components are provided as will be subsequently described. At the upper end of tubular housing member 21, the space between the inner bore 50 thereof and the external surface 51 of mandrel tubular member 4 provides a chamber 52. The upper end of chamber 52 is provided with a threaded opening 53 in which a threaded plug member 54 is secured. Threaded opening 53 provides for the introduction of hydraulic fluid (or other suitable operating fluid) as will be subsequently described.

The exterior surface of tubular mandrel member 4 is of slightly reduced diameter at the lower end portion 55 thereof and is provided with a plurality of longitudinally extending grooves 56 with splines 56*a* therebetween (in FIGS. 1*a* and 3). The lower end portion of housing tubular member 21 is provided with an inner bore 57 of reduced diameter forming an upper shoulder 58 and having a plurality of longitudinally extending grooves 59 therein circumferentially spaced to define a plurality of splines 60 which fit into grooves 56 in upper tubular mandrel member 4 (in FIGS. 1*a* and 3). The grooves 56 and 59 in tubular housing member 21 and in tubular mandrel member 4 are of greater depth than the height of the splines 56*a* and 60 positioned in those grooves. As a result, passages are provided which extend longitudinally of the respective grooves in mandrel member 4 and housing member 21 as indicated at 61 and 62 (in FIGS. 1*a* and 3). The arrangement of longitudinally extending splines and grooves in tubular housing member 21 and on tubular mandrel member 4 provides a guide for longitudinal movement of mandrel 2 in housing 3 without permitting rotary movement therebetween. The passages 61 and 62 in the clearance between the splines and grooves provide for flow of hydraulic fluid between chamber 52 and the lower portions of the apparatus as will be subsequently described.

In FIG. 1*b*, it is seen that the clearance between tubular housing member 25 and mandrel members 4 and 9 is such that there is provided a hydraulic chamber 63 of substantially enlarged size relative to hydraulic chamber 52. The lower end of tubular housing member 21 provides an upper anvil surface 64 which is utilized when this apparatus jars in an upward direction. The inner surface 65 of tubular housing member 25 constitutes a counterbore which produces an internal circumferential shoulder at the lower end of hydraulic chamber 63 which functions as an anvil 66 when the apparatus jars in a downward direction.

The lower end portion 67 of tubular mandrel member 4 has the external surface 55 thereof threaded as indicated at 68. A hollow cylindrical hammer 69, having internal threads 70, is threadedly secured on the threaded portion 68 of tubular mandrel member 4 and is provided with a threaded plug or set screw 71 which extends through threaded opening 72 into recess 73 in tubular mandrel member 4. Hollow cylindrical hammer member 69 is therefore threadedly secured on the lower end portion of tubular mandrel member 4 and further secured by set screw 71 against rotation during operation. The upper end portion 74 of hammer 69 is engageable during operation with the anvil surface 64 on housing member 21. The lower hammer surface 75 of hammer member 69 is engageable with anvil surface 66 during downward operation of the apparatus.

Tubular mandrel portion 9 is provided with a plurality of longitudinally extending grooves 76 (in FIGS. 1*b* and 2). Grooves 76 provide flow passages for flow of hydraulic fluid as will be subsequently described. Tubular sleeve member 77 is supported on tubular mandrel member 9 and has an internal surface 78 spaced from the exterior surface of mandrel member 9 to provide an annular flow passage 79 (in FIG. 1*b*).

Tubular member 77 is provided with apertures 80 which open from passage 79 into hydraulic chamber 63. It is also provided with apertures 81 which open from passage 79 into the lower end portion of hydraulic chamber 63. The lower end of passage 79 also overlaps the upper end of grooves or passages 76 to provide continuous fluid communication between hydraulic chamber 63 and grooves 76. The upper end of tubular member 77 abuts the lower end of tubular mandrel member 4. The lower end of tubular member 77 is, in turn, abutted by the upper end of a tubular sleeve member 82 which fits tightly over the external surface of mandrel member 9 in which grooves 76 are formed. Sleeve 82 therefore encloses the grooves 76 and defines a system of longitudinally extending passages. The lower end of sleeve 82 abuts an annular spacer ring 83 which is provided with a plurality of apertures 84 opening from the ends of grooves or passages 76. Tubular sleeve 82 is also provided with a plurality of apertures or openings 85 which are controlled by a tripping valve which will be subsequently described.

The inner surface 86 of housing member 29 and the outer surface 87 of tubular sleeve member 82 are spaced apart to define a hydraulic chamber 88. Surfaces 86 and 87 are smooth cylindrical surfaces permitting free movement of a pressure piston supported therebetween. At the upper end of hydraulic chamber 88, there is provided an annular pressure piston 89 (FIGS. 1*b* and 4) which fits between surfaces 86 and 87 for sliding movement. Piston 89 is sealed against fluid leakage by O-rings 90 and 91 fitting in grooves 92 and 93, respectively. Piston 89 is provided with one or more passages 94 which provide for a very small leakage flow of hydraulic fluid through the piston. Alternatively, leakage flow can be provided by a loose fit of the piston or the need for leakage flow can be eliminated by use of a compressible hydraulic fluid. In FIG. 4, the piston 89 is shown in more detail but the section is taken on a different plane. In this view, it is seen that the peripheral groove into which control arm flange 123 is fitted is formed by a removable annular member 137 held in place by screws or bolts 138. The leakage passage 94 is not seen in this view but is indicated schematically by the dotted line.

Approximately midway of the length of hydraulic chamber 88, there is provided a tripping valve 95 (in FIGS. 1*c* and 6) for controlling the release of hydraulic fluid from chamber 88. Tripping valve 95 consists of two separately movable valve members 96 and 97. Valve member 96 is annular in shape and fits the outer surface 87 of tubular sleeve 82 for sliding movement thereon. Valve member 96 is sealed on its inner surface by O-ring 98 fitting in annular groove 99. Valve member 96 has a tubular extension 100 having a counterbore 101. The external surface of tubular extension 100 is undercut as indicated at 102 between peripheral flanges 103 and 104. Valve member 97 is similarly constructed with a sliding fit on the external surface 87 of tubular sleeve 82 and is sealed against fluid leakage by O-ring 105 positioned in annular groove 106. Valve member 97 similarly has a tubular extension 107 with a counterbore 101*a* and with an external surface undercut as at 108 between circumferential flanges 109 and 110, respectively. Tripping valve 95 is shown in more detail in FIG. 6 where it is seen that the tripping valve member 96 has a plurality of guide fingers 139 which guide the movement of valve member 97 in opening and closing to prevent misalignment. Guide fingers 139 are spaced apart sufficiently to permit flow of hydraulic fluids therebetween when tripping valve 95 is opened.

An annular pressure piston 111, which is substantially the same as piston 89, is positioned at the lower end of hydraulic chamber 88 (in FIG. 1*c*). Piston 111 has a sliding fit between surfaces 86 and 87 and is sealed against leakage of hydraulic fluid by O-rings 112 and 113 positioned in grooves 114 and 115, respectively. Piston 111 is provided with a longitudinal passageway 116 which is closed by a ball check valve 117.

A coil spring 118 is positioned between upper piston 89 and upper tripping valve member 96. A coil spring 119 is similarly positioned between lower piston 111 and lower tripping valve member 97. Springs 118 and 119 urge tripping valve members 96 and 97 toward engagement and urge hydraulic piston members 89 and 111 toward opposite ends of hydraulic chamber 88.

The apparatus, as shown in FIGS. 1*b* and 1*c*, is in a neutral position with upper pressure piston member 89 abutting the end 120 of tubular housing member 25 as the limit of movement of the piston. Similarly, in this neutral position, the lower piston 111 is positioned against peripheral shoulder 121 at the lower end of hydraulic chamber 88.

An actuating member or control arm 122 is positioned to interconnect upper pressure piston member 89 with the lower tripping valve member 97. Control arm 122 is constructed as a segment of a cylinder and constitutes approximately one-fourth of a cylinder. Control arm 122 is provided with inwardly extending flanges 123 and 124 at opposite ends thereof (in FIG. 5). Flange 123 fits into the peripheral surface of piston 89 and control arm 122 extends longitudinally therefrom (in FIG. 1*b*). Flange 124 of control arm 122 extends into sliding engagement with the undercut surface 108 of tripping valve member 97 (in FIG. 1*c*).

A similar actuating member or control arm 125, which is identical in construction to control arm 122, has a flange 126 at one end fitting into the peripheral surface of lower piston 111 and a flange 127 at the opposite end fitting into sliding engagement with the undercut surface 102 of tripping valve member 96 (in FIG. 1*c*).

The apparatus is provided with two of the control arms 122 positioned diametrically apart and two of the control arms 125 positioned diametrically apart and between control arms 122. As a result of this arrangement, it will be apparent that the section seen in FIGS. 1*b* and 1*c* is not exactly true. The section through one of the control arms 122 or 125 must be taken in a plane rotated 90° from the other in order to show both of the control arms in the same view.

Below the shoulder 121 on which lower pressure piston 111 rests, there is a fluid chamber 128 (in FIGS. 1*c* and 1*d*) formed by the outer surface 129 of mandrel portion 13 and the inner surface 130 of housing portion 29. The lower end of fluid chamber 128 is closed by annular piston 131 positioned for sliding movement therein. Piston 131 is sealed against fluid leakage by O-rings 132 and 133 positioned in grooves 134 and 135, respectively. Piston 131 abuts and is urged upward by spring 136 which is supported on cap member 17 on the lower mandrel member 19.

OPERATION

The apparatus described above is a double acting hydraulic drilling jar which can be used to apply impact or jarring forces to drill pipe or to an object stuck in a well or for any other purpose where a jarring action is required. The drilling jar may be operated either upwardly or downwardly to apply impact or jarring forces for dislodging an object stuck in a well. In the operation of a drilling jar in the upward direction, the drill pipe is stretched by an axial tensile pull applied at the surface. The application of this tensile force is resisted by the tripping mechanism of the jar long enough for the pipe to stretch and store potential energy. When the jar reaches a tripping position, the stored energy in the stretched pipe is converted to kinetic energy which causes the impact surfaces, i.e. hammer and anvil, of the jar to move together and strike at a high velocity, thus applying a very high impact force.

When the jar is operated in a downward direction, the pipe weight is slacked off at the surface to put the pipe in compression. This compressive force is resisted by the tripping mechanism of the jar and allows the pipe to compress and store potential energy. When the jar reaches the tripping position, the potential energy of the pipe compression and the pipe weight is converted to kinetic energy by the sudden release of the pipe allowing the hammer and anvil surfaces of the jar to come together at a very high velocity, thus producing a high impact force. The apparatus described above is a novel drilling jar which operates in either the upward or downward direction and is tripped hydraulically. The principle of operation and the sequence of movement of the various parts will be described below to provide a clearer understanding of the invention.

THE NEUTRAL POSITION

When the drilling jar 1 is assembled, as described above, it is filled with a hydraulic fluid through opening 53 in the upper tubular housing member 21. The hydraulic fluid used is preferably a non-compressible fluid since the apparatus operates utilizing the leakage of fluid past the pressure piston. With certain adjustments in operating clearances, the apparatus can be operated using the well drilling fluid. While non-compressible fluids are preferred, it is possible to use a compressible hydraulic fluid or a high pressure gas, but this would require a longer tool in order to allow for the additional travel required to pressurize a compressible fluid.

When the hydraulic fluid is introduced into the drilling jar 1 through opening 53, it flows to the bottom of hydraulic fluid chamber 128 which is closed by pressure balancing piston 131. The hydraulic fluid fills the space in hydraulic chamber 128 and hydraulic chamber 88 which is located between the pressure pistons 89 and 111. The hydraulic fluid also fills the various passages including passages 76 and 79 leading to hydraulic fluid chamber 63. This chamber is filled with fluid on up into hydraulic fluid chamber 52 in which the fluid extends up to the level of the filling opening 53. The apparatus can be inclined somewhat to work out air bubbles in the filling so that it is completely filled with fluid up to the opening 53. At this point, filling plug 54 is inserted and the apparatus is ready for use. The pressure balancing piston 131 allows for thermal expansion of the fluid and also allows the hydrostatic pressure of the fluid in the well bore which surrounds the jar to keep the fluid in the jar under sufficient pressure to cause it to complete its path of flow from one section of the apparatus to another.

In the embodiment of the invention as shown in FIGS. *1a–1d*, the apparatus is in a neutral position from which it can be moved upward to produce an upward jarring force or downward to produce a downward jarring force. In this neutral position, the hammer 69 is positioned about midway between the upper anvil surface 64 and lower anvil surface 66. The pressure pistons 89 and 111 are moved apart to the maximum extent of their movement and are held against shoulders 120 and 121 by the force of springs 118 and 119. In this position, the springs 118 and 119 also function to hold the separate parts 96 and 97 of tripping valve 95 in closed position (in FIG. *1c*). The valve parts 96 and 97 are also held closed by hydraulic pressure. In this position, the actuating members or control arms 122 and 125 are in intermediate or neutral positions with respect to the operation of the tripping valve members 96 and 97. The apparatus will be first described in providing a downward jarring function.

DOWNWARD JARRING

The apparatus is connected in a drill string with the upper threaded opening 6 connected to a drill pipe and the lower threaded connection 37 or sub 32 connected to a "fish" or other object to which a jarring action is to be applied. To provide a downward jarring function, the upper drill pipe is slacked off and placed under compression. This applies a compressive force downward against mandrel 2 and attempts to move the mandrel downward in relation to housing 3. Downward movement is shown successively in FIGS. *7a–10b*. The downward movement of mandrel 2 occurs relatively freely at the start, and the movement is a sliding movement relative to housing 3 and to pressure pistons 89 and 111. During this phase of movement, the bottom end or shoulder 140 of sleeve member 77, on mandrel portion 9, is brought into engagement with the top surface of pressure piston 89. At this point, further movement of mandrel 2 will cause shoulder 140 to move pressure piston 89 downward in fluid pressure chamber 88. The further stage in this movement is seen in FIG. *7a* where mandrel 2 has caused pressure piston 89 to move away from shoulder 120 on which it is positioned when the apparatus is in the neutral position shown in FIG. *1b*.

Movement of pressure piston 89 by shoulder 140 on mandrel 2 causes actuating member or control arm 122 to move the end flange portion 124 until it engages the end flange 110 on tripping valve member 97. Further movement of pressure piston 89 will cause tripping valve member 97 to be moved therewith and to maintain the same relative position in relation to valve opening 85 as is shown in FIG. *7b*. As pressure piston 89 is moved downward and control arm 122 causes flange 124 to engage flange 110 and move tripping valve member 97 downward, tripping valve member 96 follows valve member 97 in downward movement under the influence of spring 118 and the elevated pressure in chamber 88 which compresses both valve parts tightly together. When the valve member 96 is moved downwardly by the pressure in chamber 88 and the spring 118, following the movement of valve member 97 by control arm 122, valve member 96 is moved relative to control arm 125 extending from lower pressure piston 111. The end flange 127 of control arm 125 remains in a stationary position and valve member 96 moves past it until flange 127 engages the end flange 103 of valve member 96 (in FIG. 8). At this point, any further movement of pressure piston 89 toward piston 111 will cause the relative movement of control arms 125 and 122 to begin to separate the valve members 96 and 97 which comprise tripping valve 95.

Up to this point, the relative movement of pressure piston 89 and pressure piston 111 and control arms 122 and 125 has been described as if the movement were unobstructed. It should be noted, however, that the fluid pressure chamber 88 which is enclosed by pressure piston 89 and 111 and tripping valve 95 is a completely closed chamber except for the very small opening or orifice 94 through piston 89. The downward movement of piston 89 begins to pressurize the hydraulic fluid in chamber 88 and the fluid pressure resists movement of the piston. As the compressive force applied to mandrel 2 is increased by the weight applied by the drill string above the drilling jar, the hydraulic pressure in fluid chamber 88 increases as a result of the load imposed on pressure piston 89. The check valve 117 in pressure stretched upward, it places the mandrel 2 under tension and moves it to the limit permitted by the tripping mechanism. The upward movement of mandrel 2 from the neutral position shown in FIGS. 1*a*–1*d*, first brings shoulder 141 of ring member 83 into engagement with the bottom end of lower pressure piston 111. This initial upward movement by mandrel 2 does not yet start to actuate tripping valve 95 or apply any pressure to the fluid in the system.

As mandrel 2 moves further upward, shoulder 141 engages the bottom end of lower pressure piston 111 and moves the same upward therewith. Upward movement of piston 111 also causes its control arms 125 to move relative to upper piston 89 and its control arms 122. Further movement of pressure piston 111 upward, by movement of mandrel 2, results in the resistance to movement building up because of the hydraulic fluid which fills chamber 88. When pressure piston 111 moves upward, pressure is applied to the fluid in chamber 88 and a very high hydraulic pressure is rapidly achieved. The fluid can not flow out through check valve 117 or tripping valve 95, both of which are closed at this stage of operation. The fluid in chamber 88 can only leak very slowly through passage 94 in upper piston 89. This permits upward movement of piston 111 at a rate determined by the amount of fluid which has leaked from chamber 88 through passage 94. During this upward movement, the hydraulic fluid in chamber 88 is maintained under a very high pressure which represents the pressure created by the tension applied to mandrel 2 from the drilling string.

As mandrel 2 moves further upward, the lower pressure piston 111 and its control arms 125 move upward relative to housing portion 29 and relative to upper position 89 and upper valve member 96. After additional further upward movement, the apparatus reached the position shown in FIGS. 11*a* and 11*b* where flange 127 on control arm 125 has engaged the upper flange 103 on upper valve member 96 of tripping valve 95. Further upward movement of lower piston 111 and control arms 125 moves upper valve member 96 upward and allows the lower valve member 97 to move along with it until flange 124 on control arm 122 engages the lower flange 110 on valve member 97. The position just described is an intermediate position, not shown in the drawings, just prior to reaching the position shown in FIGS. 12*a* and 12*b*.

In this position, the hydraulic fluid in chamber 88 is under a very high pressure and is resisting movement of piston 111 which provides the resistance to movement of mandrel 2 allowing the build up of a substantial amount of tension in the mandrel and in the drill string. When mandrel 2 moves further upward, the movement of control arm 125 and flange 127 by pressure piston 111 causes upper valve member 96 to move away from valve member 97 to open tripping valve 95. The position which is reached very shortly after tripping valve 95 is opened is that shown in FIGS. 12*a* and 12*b*. In this position, tripping valve 95 is open and fluid is free to flow through valve opening 85 and the various passages in communication therewith to the other fluid chambers 128, 63 and 52. When tripping valve 95 is opened, the fluid in chamber 88 is released to flow to the other fluid chambers and the pressure in chamber 88 drops substantially to hydrostatic pressure in the well bore. This drop in pressure removes the resistance to upward movement by pressure piston 111 and permits that piston and mandrel 2 to move rapidly for the remaining length of the jarring stroke.

This last rapid movement is the movement between the positions shown in FIGS. 12*a* and 12*b* and the position shown in FIGS. 13*a* and 13*b*. This movement is one in which the tripping valve is opened wide, as seen in FIG. 13*b*, and mandrel 2 has moved upward to the point where the upper surface 74 of hammer 69 has engaged anvil shoulder 64 with a hammer or impact blow. This last rapid movement releases the tensile energy in mandrel 2 and the drill string in the form of kinetic energy moving hammer 69 at a very high speed into jarring impact with anvil shoulder 64. At the point of engagement of hammer 69 with anvil shoulder 64, the apparatus has reached the point of maximum upward movement. The movement of mandrel 2 is thus limited in an upward direction by engagement of hammer 69 with anvil shoulder 64 and in a downward direction by engagement of hammer 69 with anvil surface 66, as previously described.

RECOCKING AFTER UPWARD JARRING

After reaching the upward limit of movement shown in FIGS. 13*a* and 13*b*, the apparatus is recocked for further use by moving mandrel 2 back to the neutral position of FIGS. 1*a*–1*d*. As mandrel 2 moves downward, hammer 69 moves away from anvil surface 64. Pressure piston 111 and its control arms 125 move downward along with mandrel 2 and the lower valve member 97 remains relatively stationary against control arm 122 while upper valve member 96 moves downward along with mandrel 2. Fluid chamber 88 is filled with hydraulic fluid flowing through opening 85 and open valve 95 during this downward movement of pressure piston 111.

As mandrel 2 moves further downward, valve members 96 and 97 reach the position shown in FIG. 12*b* and after a small amount of further movement those valve members close against each other and fluid chamber is then substantially closed. As mandrel 2 and lower pressure piston 111 continue to move downward, fluid which is displaced from below piston 111 may enter chamber 88 through check valve 117 or through bleed passage in upper piston 89. After somewhat further movement, the apparatus again reaches the position shown in FIGS. 11*a* and 11*b* and finally lower piston 111 comes to rest against shoulder 121. Mandrel 2 continues to move for a short distance until shoulder 141 has moved away from the lower end of piston 111. At this point, the apparatus is again in the neutral position shown in FIGS. 1*a*–1*d*. In this position, the apparatus is recocked and is ready for further jarring movement in either an upward or downward direction as desired.

DESCRIPTION OF AN ALTERNATE EMBODIMENT

Referring to the drawings, and particularly to FIGS. 14*a*–14*d*, inclusive, there is shown a double acting hydraulic drilling jar 201 which is of substantial length necessitating that it be shown in four longitudinally broken quarter sectional views, viz. FIGS. 14*a*, 14*b*, 14*c* and 14*d*. Each of these views is shown in longitudinal section extending from the center line of the jar to the outer periphery thereof. This embodiment differs from the one just described in that a double dashpot arrangement is substituted for the two-part tripping valve for producing the tripping action.

piston 111 prevents the flow of fluid outward through that piston. The closed valve members 96 and 97 of tripping valve 95 also prevent the flow of hydraulic fluid from the chamber at that point. It should be noted that the closed valve members 96 and 97 are urged into tighter closure due to the elevated pressure in chamber 88 acting on an annular area from the valve seal point 95*a* to the outer surface 87 of sleeve 82. The only point of exit of fluid from chamber 88 during this phase of operation is through the very small bleed passage 94 in piston 89. The size of bleed passage 94 is such that the hydraulic fluid can flow through it at a very slow rate only when subjected to a relatively high pressure.

As the force applied to pressure piston 89 increases, this piston attempts to move downward against the hydraulic fluid in chamber 88 but is resisted by the fluid in the chamber and can move only as the fluid is bled off through orifice 94. The fluid in chamber 88 is therefore maintained under a very high pressure and the piston 89 moves slowly downwardly to maintain the pressure in chamber 88 as fluid flows from the chamber 88 through the opening 94. When the pressure piston 89 has moved downward to the point where the end flanges 124 and 127 of control arms 122 and 125 have reached engagement with the end flanges 103 and 110 of valve members 96 and 97, the position of these components is as illustrated in FIG. 8 and the hydraulic fluid in chamber 88 is still under a very high pressure. The position shown in FIG. 8 is immediately prior to opening movement of the tripping valve 95. At this point, the hammer 69 on mandrel 2 has moved only a fraction of the distance downward toward anvil 66. Mandrel 2, however, at this point is under a very high compressive force applied by the drill string above and will release that force to move hammer 69 at a high speed and with a high impact against anvil 66 whenever the resistance to further movement is released.

Further downward movement of pressure piston 89 relative to piston 111 will cause the end flanges 124 and 127 of control arms 122 and 125 to move valve members 96 and 97 apart to open the tripping valve 95. The position of valve members 96 and 97 a very short time after this opening movement is illustrated in FIG. 9*b*. When the tripping valve 95 is opened, even to the small extent shown in FIG. 9*b*, the fluid in hydraulic fluid chamber 88 is permitted to flow out through the opened tripping valve 95 and through opening 85 and the various passages to the various fluid chambers which are not under elevated pressure. Thus, when tripping valve 95 is opened, the fluid in chamber 88 can flow through passages 76 and 79 into fluid chamber 63 located above the downwardly moving pressure piston 89. Fluid is also free to move from chamber 88 through passage 76 downwardly into fluid chamber 128 above pressure balancing piston 131. This sudden release of fluid from chamber 88 releases virtually all resistance to downward movement of pressure piston 89. At this point, piston 89 moves rapidly downward under the influence of the high potential energy built up by compression and weight of the drill string, which energy has been applied to mandrel 2 of the drilling jar. The rapid downward movement of piston 89 allows mandrel 2 to move along with it very rapidly and causes hammer 69 to bring hammer face 75 into engagement with anvil surface 66 with a very high impact force. This position, which is shown in FIGS. 10*a* and 10*b*, represents the maximum downward movement of mandrel 2.

RECOCKING AFTER DOWNWARD JARRING

The drilling jar is recocked for further operation, either in a downward or upward direction by moving mandrel 2 upward from the position shown in FIGS. 10*a* and 10*b* to the position shown in FIGS. 1*a*–1*d*. As the mandrel 2 is moved upward, piston 89 moves upward with it under the influence of springs 118 and 119. In this upward movement, it should be noted that spring 118 is bearing against valve member 96 which is supported on flange 127 of control arm 125 which is maintained in a fixed position in this stage of operation. Likewise, spring 119 bears against lower pressure piston 111 and pressed against the lower end of valve member 97 and flange 125 of control arm 122, also urging piston 89 upward. As piston 89 is moved upward by retraction of mandrel 2, mandrel portion 9, lower tripping valve member 97, control arm 122 and piston 89 maintain the same relative position and move upward relative to housing 3. This upward movement is also relative to lower pressure piston 111 and control arm 125 and upper valve member 96. As this upward movement of the mandrel 2 continues, valve member 96 approaches valve member 97 and eventually reaches the position corresponding to FIG. 8. During this upward movement, the volume of chamber 63 is reduced by movement of piston 89 which causes fluid to flow from that chamber through the various connecting passages into the fluid chamber 88 between the upper pressure piston 89 and the lower pressure piston 111. By the time that the apparatus has returned to the position shown in FIG. 8, the chamber 88 has filled with hydraulic fluid. At this point, chamber 88 is closed against entry of fluid through tripping valve 95 but additional fluid can enter through check valve 117 and through bleed passage 94.

Further upward movement of mandrel 2 and piston 89 brings the apparatus to the position shown in FIGS. 7*a* and 7*b*. In this position, valve members 97 and 96 of tripping valve 95 are closed together and flange 127 has moved away from flange 103 and toward flange 104 on valve member 96. Further upward movement of mandrel 2 and upper pressure piston 89 moves control arm 122 and its operating flange 124 upward away from flange 110 on valve member 97 until it reaches the position shown in FIG. 1*c*. During this upward movement, upper pressure piston 89 reaches the point of engagement with shoulder 120 on upper housing member 25. Further upward movement of mandrel 2 reaches the position shown in FIG. 1*b*, where upper pressure piston 89 rests against shoulder 120 and shoulder 140 on mandrel 2 has moved away from piston 89. This is the neutral position of the apparatus described above at the start of the down stroke for the downward jarring motion. At this point, the apparatus has been recocked for further use and can be jarred downward again, if desired, or may be jarred upward if that type of jarring operation is needed.

UPWARD JARRING

When this drilling jar is operated in an upward direction from the neutral position shown in FIGS. 1*a*–1*d*, the operation is substantially the same as in the downward jarring operation but different components are involved in reaching that result as shown in FIGS. 11*a*–13*b*. When the apparatus is to be used for an upward jar, the drill string to which the upper end 5*a* of mandrel 2 is attached is stretched upward and placed under the desired degree of tension. As the drill string is Drilling jar 201 comprises inner tubular mandrel 202 telescopingly supported inside outer tubular housing 203. Mandrel 202 and housing 203 each consists of a plurality of segments or parts which must be described in further detail.

Mandrel 202 consists of an upper tubular portion 204 (FIGS. 14*a* and 14*b*) having an inner longitudinal passage 205 extending therethrough. The upper end of upper portion 204 is enlarged as indicated at 205*a* and is internally threaded at 206 for connection to a drill string. The lower end of mandrel portion 204 is provided with a counterbore ending in internal shoulder 207 and internally threaded as indicated at 208. An intermediate portion of mandrel 202 consists of tubular sleeve member 209 (FIGS. 14*b* and 14*c*) which has its upper end threaded as indicated at 210 for connection inside threaded portion 208 of member 204 with the upper end portion abutting shoulder 207. The lower end of sleeve member 209 is threaded externally as indicated at 211 and is provided with an internal bore or passage 212 which is a continuation of passage 205 in mandrel portion 204. The lower end of mandrel 202 consists of tubular member 213 (FIG. 14*d*) which is provided with a counterbore ending in shoulder 214 and internally threaded as indicated at 215. Tubular portion 213 is threadedly assembled on the lower end of tubular member 209 with the lower end thereof abutting shoulder 214.

The lower end portion of tubular member 213 is externally threaded as indicated at 216. A sleeve member 217 having internal threads 218 is threadedly secured on the lower end of tubular member 213 for supporting a spring which will be subsequently described. Tubular portion 213 is provided with an inner longitudinal passage 219 which is an extension of passages 205 and 212 and opens through the central opening 220 of sleeve member 217. The three portions 204, 209 and 213 are threadedly assembled, as shown, into a single mandrel 202 which is longitudinally moveable inside tubular housing 203 as will be subsequently described.

Tubular housing 203 is formed in several sections, for purposes of assembly, somewhat similarly to mandrel 202. The upper end of tubular housing 203 consists of tubular member 221 (FIGS. 14*a* and 14*b*) which has a smooth inner bore 222 at its upper end in which the exterior surface of upper mandrel tubular member 204 is positioned for longitudinal sliding movement. The lower end portion of tubular housing member 221 has a portion of reduced diameter forming an annular shoulder 223 and having an exterior threaded portion 224.

Tubular housing 203 is provided with an intermediate tubular portion 225 (FIGS. 14*a* and 14*b*) which is internally threaded as indicated at 226 at its upper end. The lower end portion of tubular member 225 has a portion of reduced diameter forming shoulder 227 and externally threaded as indicated at 228.

The lower portion of tubular housing 203 consists of tubular member 229 (FIGS. 14*b*, 14*c* and 14*d*) which is internally threaded as indicated at 230 at its upper end for threaded connection to the threaded portion 228 of intermediate tubular housing portion 225. The upper end of the lower tubular housing portion 229 abuts shoulder 227 when the threaded connection is made up tight. The lower end of tubular housing portion 229 is internally threaded as indicated at 231 (FIG. 14*d*).

At the lower end of tubular housing 202 there is provided a tubular connecting member or sub 232 which is externaly threaded, as indicated at 233, at its upper end and has a shoulder 234 against which the lower end of tubular housing member 229 abuts when the threaded connection 231, 233 is made up tight. Connection sub 232 has an inner longitudinal passage 235 which is a continuation of the passages through mandrel 202. The lower end of sub 232 is of reduced diameter as indicated at 236 and provided with an externally threaded surface 237 for connection into the lower portion of a drill string or for connection to a fish, when the apparatus is used as a fishing jar.

As has already been noted, the mandrel 202 and housing 203 are each formed of several threadedly connected sections for purposes of assembly. Mandrel 202 is arranged for sliding movement inside housing 203. The apparatus will be charged with hydraulic fluid, as will be subsequently described, and it is therefore necessary to provide seals against leakage from several points of assembly and also from the point of sliding engagement between mandrel 202 and housing 203.

As previously noted, the exterior surface of the upper mandrel portion 204 has a sliding fit in the bore 222 of the upper tubular portion 221 of housing 203. Tubular member 221 is provided with an internal annular groove 238 in which there is positioned an O-ring 239 which seals that sliding joint against leakage of hydraulic fluid. The threaded connection between tubular housing portions 221 and 225 is sealed against leakage of hydraulic fluid by O-ring 240 (in FIG. 14*b*) which is positioned in external peripheral groove 241 in the lower end of tubular housing member 221. The threaded connection between tubular housing members 225 and 229 is similarly sealed against fluid leakage by O-ring 242 (FIG. 14*b*) which is positioned in peripheral groove 243 in the lower end portion of housing member 225.

The threaded connection between the lower end of tubular housing member 229 and connecting sub 232 is similarly sealed against leakage of fluid by O-ring 244 (FIG. 14*d*) positioned in annular groove 245 in the upper end of sub 232. Similar seals are provided to prevent leakage through the threaded joints connecting the several sections of mandrel 202. The threaded connection between upper tubular portion 204 and intermediate tubular portion 209 of mandrel 202 is sealed against leakage by O-ring 246 (FIG. 14*b*) which is positioned in inner annular groove 247 in the lower end portion of the upper tubular mandrel member 204. The threaded connection between intermediate tubular mandrel member 209 and lower tubular mandrel member 213 is similarly sealed against leakage by O-ring 248 (FIG. 14*d*) which is positioned in inner circumferential groove 249.

The space between the inner bore of the various components of housing 203 and the external surface of mandrel 202 provides an enclosed chamber and passages for flow of hydraulic fluid through this drilling jar. Various additional components are provided as will be subsequently described. At the upper end of tubular housing member 221 the space between the inner bore 250 thereof and the external surface 251 of mandrel tubular member 204 provides a chamber 252. The upper end of chamber 252 is provided with a threaded opening 253 in which a threaded plug member 254 is secured. Threaded opening 253 provides for the introduction of hydraulic fluid as will be subsequently described.

The exterior surface of tubular mandrel member 204 is of slightly reduced diameter at the lower portion 255 thereof and is provided with a plurality of longitudinally extending grooves 256 with splines 256*a* therebetween, as seen in FIG. 14*a*. The lower end portion of housing tubular member 221 is provided with an inner bore 257 of reduced diameter forming an upper shoulder 258 and having a plurality of longitudinally extending grooves 259 therein circumferentially spaced to define a plurality of splines 260 which fit into grooves 256 in upper tubular mandrel member 204, as seen in FIG. 14*a*.

The grooves 256 and 259 in tubular housing member 221 and is tubular mandrel member 204 are of greater depth than the height of the splines 256*a* and 260 positioned between those grooves. As a result, passages are provided which extend longitudinally of the respective grooves in mandrel member 204 and housing member 221 as indicated at 261 and 262 in FIG. 14*a*. The arrangement of longitudinally extending splines and grooves in tubular housing member 221 and on tubular mandrel member 204 provides a guide for longitudinal movement of mandrel 202 in housing 203 without permitting rotary movement therebetween. The passages 261 and 262 in the clearance between the splines and grooves provide for flow of hydraulic fluid between chamber 252 and the lower portions of the apparatus as will be subsequently described.

Figure 14B:
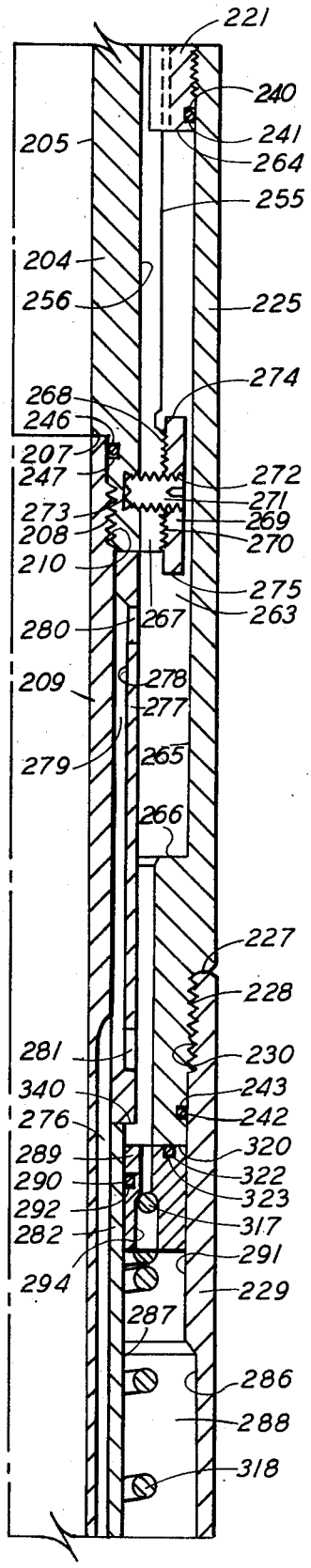
Figure 14C:
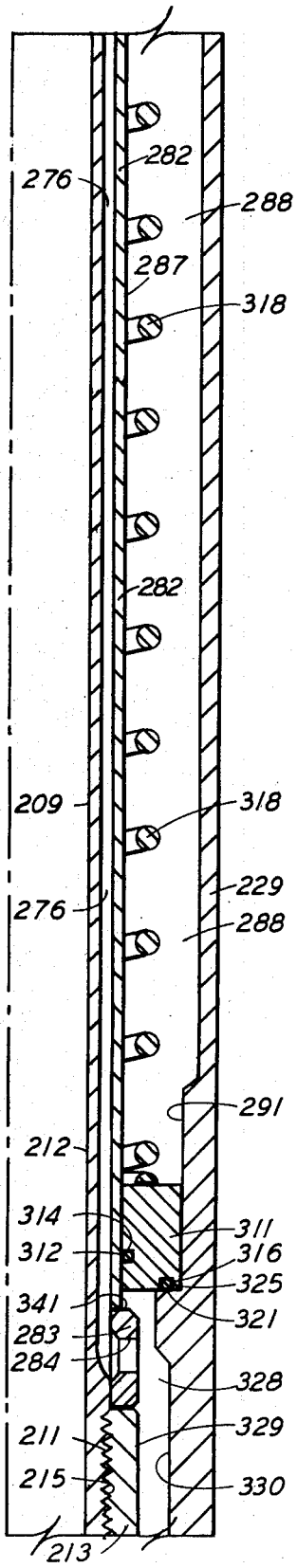
Figure 14D:
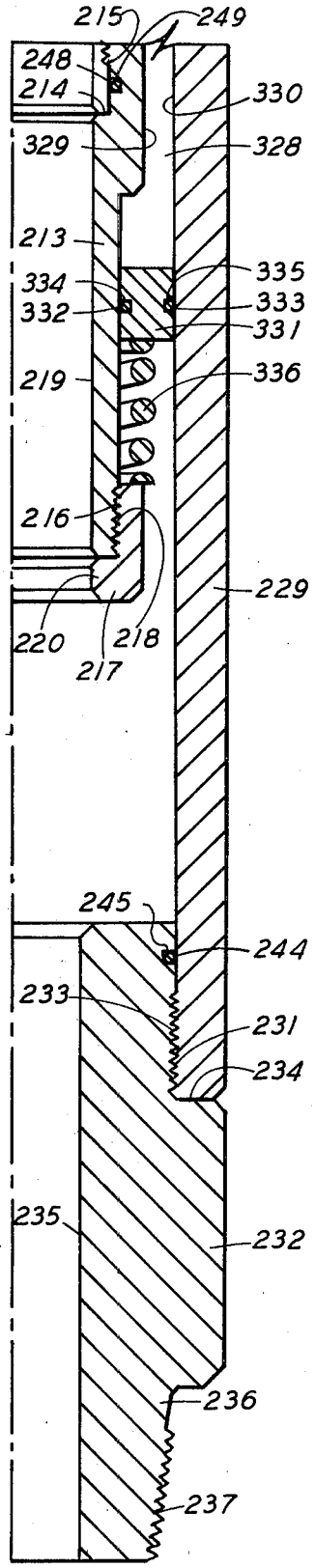

In FIG. 14*b*, it is seen that the clearance between tubular housing member 225 and mandrel members 204 and 209 is such that there is provided a hydraulic chamber 263 of substantially enlarged size relative to hydraulic chamber 252. The lower end of tubular housing member 221 provides an upper anvil surface 264 which is utilized when this apparatus functions in the upward jarring mode. The inner surface 265 of tubular housing member 225 constitutes a counterbore which produces an internal circumferential shoulder at the lower end of hydraulic chamber 263 which functions as an anvil 266 when the apparatus is functioning in the downward jarring mode.

The lower end portion 267 of tubular mandrel member 204 has the external surface 255 thereof threaded as indicated at 268. A hollow cylindrical hammer 269 having internal threads 270 is threadedly secured on the threaded portion 268 of tubular mandrel member 204 and is provided with a threaded plug or set screw 271 which extends through threaded opening 272 into a recess 273 in tubular mandrel member 204. Hollow cylindrical hammer member 269 is therefore threadedly secured on the lower end portion of tubular mandrel member 204 and further secured by set screw 271 against rotation during operation. The upper end portion 274 of hammer 269 is engageable during operation with the anvil surface 264 on housing member 221. The lower hammer surface 275 of hammer 269 is engageable with anvil surface 266 during downward operation of the apparatus.

Tubular mandrel portion 209 is provided with a plurality of longitudinally extending grooves 276, as seen in FIG. 14*b*. Grooves 276 provide flow passages for flow of hydraulic fluid as will be subsequently described. Tubular sleeve member 277 is supported on tubular mandrel member 209 and has an internal surface 278 spaced from the exterior surface of mandrel member 209 to provide an annular flow passage 279 (in FIG. 14*b*).

Tubular member 277 is provided with apertures 280 which open from passage 279 into hydraulic chamber 263. It is also provided with apertures 281 which open from passage 279 into the lower end portion of hydraulic chamber 263. The lower end of passage 279 also overlaps the upper end of grooves or passages 276 to provide continuous fluid communication between hydraulic chamber 263 and grooves 276. The upper end of tubular member 277 abuts the lower end of tubular mandrel member 204. The lower end of tubular member 277 is, in turn, abutted by the upper end of a tubular sleeve member 282 which fits tightly over the external surface of mandrel member 209 in which grooves 276 are formed. Sleeve 282 therefore encloses the grooves 276 and defines a system of longitudinally extending passages. The lower end of sleeve 282 abuts an annular spacer ring 283 which is provided with a plurality of apertures 284 opening from the ends of grooves or passages 276.

The inner surfaces 286 and 291 of housing member 229 and the outer surface 287 of tubular sleeve member 282 are spaced apart to define a hydraulic chamber 288. Surface 287 is a smooth cylindrical surface permitting free movement of a pressure piston which will be subsequently described. At the upper end of hydraulic chamber 288 there is provided an annular pressure piston 289 (FIG. 14*b*) which fits on surface 287 for sliding movement. Piston 289 is sealed against fluid leakage by O-ring 290 fitting in groove 292. Piston 289 has a loose fit in the bore 291 in housing portion 229 which provide for a very small, leakage flow of hydraulic fluid around the piston. Movement of piston 289 in the bore 291 is substantially a dashpot action. The end face of piston 289 which is initially seated against shoulder 320 is provided with an annular groove 322 in which there is provided a rubber sealing ring 323 which seals against leakage of fluid around the piston while in the seated position. Piston 289 has a longitudinal passage 294 with a check valve 317 therein which permit flow of hydraulic fluid therethrough during recocking of the drilling jar.

In the middle portion of hydraulic chamber 288, the bore of housing portion is enlarged as indicated at 286. At the lower end of hydraulic chamber 288, below the enlarged bore 286, (FIG. 14*c*) there is provided an annular pressure piston 311 which is substantially the same as piston 289. Piston 311 has a sliding fit on surfaces 287 and is sealed against leakage of hydraulic fluid by O-ring 312 positioned in groove 314. The end face of piston 311 which is initially seated against shoulder 321 is provided with an annular groove 316 in which there is provided a rubber sealing ring 325 which seals against leakage of fluid around the piston while in the seated position.

A coil spring 318 is positioned between upper piston 289 and lower piston 311. Spring 318 urges hydraulic piston members 289 and 311 toward the opposite ends of hydraulic chamber 288 against end shoulders 320 and 321. In the position shown in FIGS. 14*b* and 14*c*, the apparatus is in a neutral position with upper hydraulic piston 289 and lower piston 311 positioned as shown.

Below the shoulder 321 on which lower pressure piston 311 rests, there is a fluid chamber 328 (FIGS. 14*c* and 14*d*) formed by the outer surface 329 of mandrel portion 213 and the inner surface 330 of housing portion 229. The lower end of fluid chamber 328 is closed by annular piston 331 positioned for sliding movement therein. Piston 331 is sealed against fluid leakage by O-rings 332 and 333 positioned in grooves 334 and 335, respectively. Piston 331 abuts and is urged upward by spring 336 which is supported on cap member 217 on the lower mandrel member 219.

OPERATION

The apparatus described above is a double acting hydraulic drilling jar which can be used to apply impact or jarring forces to drill pipe or to an object stuck in a well. The drilling jar may be operated either upwardly or downwardly to apply impact or jarring forces for dislodging an object stuck in a well. In the operation of a drilling jar in the upward direction, the drill pipe is stretched by an axial tensile pull applied at the surface. The application of this tensile force is resisted by the tripping mechanism of the jar long enough for the pipe to stretch and store potential energy. When the jar reaches a tripping position, the energy stored in the stretched pipe is converted to kinetic energy which causes the impact surfaces of the jar to move together and strike at a high velocity, thus applying a very high impact force.

When the jar is operated in a downward operation, the pipe weight is slacked off at the surface to put the pipe in compression. This compressive force is resisted by the tripping mechanism of the jar to allow the pipe to compress and store potential energy. When the jar reaches the tripping position, the potential energy of pipe compression and pipe weight is converted to kinetic energy by the sudden release of the pipe allowing the impact surfaces of the jar to come together in a downward direction at a very high velocity, thus producing a high impact force. The apparatus described above is a novel drilling jar which operates in either the upward or downward direction and is tripped hydraulically. This apparatus differs from the first described embodiment in that the tripping valves are eliminated and their function provided by a double dashpot mechanism. The principle of operation and the sequence of movement of the various parts will be described below to provide a clear understanding of this invention.

THE NEUTRAL POSITION

When the drilling jar 201 is assembled, as described above, it is filled with a hydraulic fluid through opening 253 in the upper tubular housing member 221. The hydraulic fluid used is preferably a noncompressible fluid since the apparatus operates utilizing the leakage of hydraulic fluid past the pressure piston. It is possible, of course, to use a compressible hydraulic fluid, but this would require careful design of the clearances of various operating parts. When the hydraulic fluid is introduced into the drilling jar 201 through opening 253, it flows to the bottom of hydraulic fluid chamber 328 which is closed by pressure balancing piston 331. The hydraulic fluid fills the space in hydraulic chamber 328 and hydraulic chamber 288, which is located between pressure pistons 289 and 311. The hydraulic fluid also fills the various passages including passages 276, 279 leading to hydraulic fluid chamber 263. This chamber is filled with fluid on up into hydraulic fluid chamber 252 in which the fluid extends up to the level of the filling opening 253. The apparatus can be inclined somwhat to work out air bubbles in the filling so that it is completely filled with fluid up to the opening 253. At this point, filling plug 254 is inserted and the apparatus is ready for use. The pressure balancing piston 331 allows for thermal expansion of the fluid and also allows the hydrostatic fluid pressure which surrounds the jar to keep the hydraulic fluid under sufficient pressure to cause it to complete its path of flow from one section of the apparatus to another.

In the embodiment of the invention shown in FIGS. **14*a*, 14*b*, 14*c* and 14*d*, the apparatus is shown in a neutral position from which it can be moved upward to produce an upward jarring force or downward to produce a downward jarring force. In this neutral position, the hammer 269 is positioned about midway between the upper anvil surface 264 and lower anvil surface 266. The pressure pistons 289 and 311 are moved apart to the maximum extent of their movement and are held against shoulders 320 and 321 by the force of spring 318**. The apparatus will be first described in providing a downward jarring function.

DOWNWARD JARRING

The apparatus is connected in a drill string with the upper threaded opening 206 connected to a drill pipe and the lower threaded connection 237 on sub 232 connected either to a lower drill pipe or to a "fish" which is to be recovered from a well. To provide a downward jarring function, the upper drill pipe is slacked off and placed under compression. This applies a compressive force downward against mandrel 202 and attempts to move mandrel 202 downward in relation to housing 203. The downward movement of mandrel 202 occurs relatively freely at the start, and the movement of the mandrel is a sliding movement relative to housing 203 and relative to pressure pistons 289 and 311. During the first phase of this movement, the bottom end or shoulder 340 of sleeve member 277, on mandrel portion 209, is brought into engagement with the top surface of pressure piston 289. At this point, further movement of mandrel 202 will cause shoulder 340 to move pressure piston 289 downward in fluid pressure chamber 288 relative to piston 311.

As the compressive force applied to mandrel 202 is increased by the slack applied to the drill string above the drilling jar, the hydraulic pressure in fluid chamber 288 increases as a result of the load imposed on pressure piston 289. Movement of pressure piston 289 by shoulder 340 on mandrel 202 is resisted by the hydraulic fluid in chamber 288. Since the fluid is substantially incompressible, there is a rapid increase in the pressure in the chamber 288. Hydraulic fluid is trapped between the pistons 289 and 311 and can flow out from chamber 288 only through the clearance around piston 289. Hydraulic fluid is prevented from flowing past piston 311 by the sealing rings 312 and 325.

As the force applied to pressure piston 289 increases, this piston moves slowly downward against the hydraulic fluid in chamber 288 but is resisted by the fluid in the chamber and can move only as the fluid is bled off around piston 289. This is essentially a dashpot operation. When the pressure piston 289 has moved downward to the point where the rear edge of the piston passes the shoulder between housing bore 291 and the enlarged bore 286 the opening around piston 289 is suddenly increased and the hydraulic fluid is free to flow past the piston virtually unobstructed. At this point, the hammer 269 on mandrel 202 has moved only a fraction of the distance downward toward anvil 266. Mandrel 202, up to this point, has been under a very high compressive force applied by the drill string above and can release that force to move hammer 269 at a high speed and with a high impact against anvil 266 whenever the resistance to further movement is released. The sudden release of fluid from chamber 288 releases virtually all resistance to downward movement of pressure piston 289. Piston 289 then moves rapidly downward under the influence of the high potential energy built up by compression of the drill string, which energy has been applied to mandrel 202 of the drilling jar. The rapid downward movement of piston 289 allows mandrel 202 to move along with it very rapidly and causes hammer 269 to bring hammer face 275 into engagement with anvil surface 266 with a very high impact force.

RECOCKING AFTER DOWNWARD JARRING

The drilling jar is recocked for further operation, either in a upward or downward direction by moving mandrel 202 upward from the position where the hammer 269 has engaged anvil 266 to the position shown in FIGS. 14*a*, 14*b*, 14*c* and 14*d*. As mandrel 202 is moved upward, piston 289 moves upward with it under the influence of spring 318. As piston 289 is moved upward by retraction of mandrel 2, mandrel portion 209 and piston 289 maintain the same relative position and move upward relative to housing 203. This upward movement is also relative to lower pressure piston 311. As this upward movement of the mandrel 202 continues, piston 289 reaches the shoulder between enlarged bore 286 and smaller bore 291 which reduces the space available for flow of hydraulic fluid back into chamber 288. Hydraulic fluid also enters chamber 288 through check valve 317 which allows the chamber 288 to fill completely. Further upward movement of mandrel 202 reaches the position shown in FIG. 14*b*, where upper pressure piston 289 rests against shoulder 320 and shoulder 340 on mandrel 202 has moved away from piston 289. This is the neutral position of the apparatus described above at the start of the down stroke for a downward jarring motion. At this point, the apparatus has been recocked for further use and can be jarred downward again, if desired, or may be jarred upward if that type of jarring operation is needed.

UPWARD JARRING

When this drilling jar is operated in an upward direction from the neutral position shown in FIGS. 14*a*–14*d*, the operation is substantially the same as in the downward jarring operation but different components are involved in reaching that result. When the apparatus is to be used for an upward jar, the drill string to which the upper end 205*a* of mandrel 202 is attached is stretched upward and placed under the desired degree of tension. As the drill string is stretched upward, it places mandrel 202 under tension and moves it to the limit permitted by the tripping mechanism.

The upward movement of mandrel 202 from the neutral position shown in FIGS. 14*a*–14*d*, first brings shoulder 341 of ring member 283 into engagement with the bottom end of lower pressure piston 311. This initial upward movement by mandrel 202 does not yet start to apply any pressure to the fluid in the system. As mandrel 202 moves further upward, shoulder 341 engages the bottom end of lower pressure piston 311 and moves that piston upward therewith. Further movement of pressure piston 311 upward, by upward movement of mandrel 202, results in the resistance to movement because of the hydraulic fluid which fills chamber 288. When pressure piston 311 moves upward, pressure is applied to the fluid in chamber 288 and a very high hydraulic pressure is rapidly achieved. The fluid can not flow out through check valve 317 or past the sealing ring 323 and 290 on piston 289. The fluid in chamber 288 can leak very slowly around piston 311. This permits upward movement of piston 311 at a rate determined by the amount of fluid which has leaked from chamber 288 past the piston. During this upward movement, the hydraulic fluid in chamber 288 is maintained under a very high pressure which represents the pressure created by the tension applied to mandrel 202 from the drilling string.

As mandrel 202 moves further upward, the lower pressure piston 311 moves upward relative to housing portion 229 and relative to upper piston 289. After additional further upward movement, the apparatus reaches the position where piston 311 is at the shoulder between the smaller bore 291 and the enlarged bore 286. In this position, the hydraulic fluid in chamber 288 is under a very high pressure and is resisting movement of piston 311 which provides the resistance to movement of mandrel 202 allowing the build up of a substantial amount of tension in the mandrel and in the drill string. When mandrel 202 moves further upward, the piston 311 moves past the shoulder into the enlarged bore 286. The space around piston 311 is then open and fluid is free to flow around the piston virtually unobstructed. The fluid in chamber 288 is released to flow to the other fluid chambers and the pressure in chamber 288 drops substantially to hydrostatic pressure in the well bore. This drop in pressure removes the resistance to upward movement by pressure piston 311 and permits that piston and mandrel 202 to move rapidly for the remaining length of the jarring stroke.

This movement is one in which mandrel 202 has moved upward to the point where the upper surface 274 of hammer 269 has engaged anvil shoulder 264 with a hammer or impact blow. This last rapid movement releases the tensile energy in mandrel 202 and the drill string in the form of kinetic energy moving hammer 269 at a very high speed into jarring impact with anvil shoulder 264. At the point of engagement of hammer 269 with shoulder 264, the apparatus has reached the point of maximum upward movement. The movement of mandrel 202 is limited in an upward direction by engagement of hammer 269 with anvil surface 264 and in a downward direction by engagement of hammer 269 with anvil surface 266, as previously described.

RECOCKING AFTER UPWARD JARRING

After reaching the upward limit of movement just described, the apparatus is recocked for further operation, either in an upward or downward direction, by moving mandrel 202 downward from the position where the hammer 269 has engaged anvil 264 to the neutral position of FIGS. 14*a*–14*d*. As mandrel 202 moves downward, hammer 269 moves away from anvil surface 264. Pressure piston 311 moves downward along with mandrel 202 relative to the lower pressure piston. Fluid chamber 288 is filled with hydraulic fluid during this downward movement first by flow around pressure piston 311 and then by flow through check valve 317. After somewhat further movement, the apparatus again reaches the position shown in FIGS. 14*a* and 14*b* and finally lower piston 311 comes to rest against shoulder 321. Mandrel 202 continues to move for a short distance until shoulder 341 has moved away from the lower end of piston 311. At this point, the apparatus is again in the neutral position shown in FIGS. 14*a*–14*d*. In this position, the apparatus is recocked and is ready for further jarring movement in either an upward or downward direction as desired.

While this invention has been described fully and completely with emphasis upon two preferred embodiments, it should be understood that, within the scope of the appended claims, this invention may be practiced otherwise than as specifically described herein. For example, the use of a compressible fluid in the apparatus makes it possible to operate without the bleed passage through the pressure piston in both embodiments. Also, in the preferred embodiment, the flow of fluid past the pressure pistons may be varied to provide a time delay for tripping in one direction which is different from that in the opposite direction. This is readily accomplished by the use of independently operated control valves in each of the pressure pistons which can be set to provide any selected time delay.

I claim:

1. A fluid actuating mechanism comprising:

inner and outer tubular members positioned in telescoping relation for limited longitudinal movement of one relative to the other, first and second piston means positioned between said inner and outer tubular members in longitudinally spaced relation for movement longitudinally therebetween, said longitudinally spaced piston means cooperating with said tubular members to define an annular chamber therein, each of said piston means being movable relative to each of said inner and outer tubular members, means limiting the movement of said first piston means in one direction, means limiting the movement of said second piston means in the opposite direction, said movement limiting means defining a predetermined initial longitudinal spacing of said first and said second piston means, said chamber being adapted to be filled with a fluid resisting relative movement of said piston means, means for moving said first piston means away from said movement limiting means toward said second piston means in response to relative movement between said tubular members in one direction, means for moving said second piston means away from said movement limiting means toward said first piston means in response to relative movement between said tubular members in the opposite direction, means permitting relative movement between said piston means when said chamber is filled with fluid, and means effective upon a first predetermined relative movement of one of said piston means toward the other away from its respective movement limiting means, and a like relative movement of one of said tubular members relative to the other, to permit rapid flow of fluid from said chamber and thereby reduce substantially the resistance to further relative movement of said piston means and movement of said tubular members therewith.

2. A fluid actuating mechanism according to claim 1 in which:

said inner and outer tubular members comprise an inner tubular mandrel and an outer tubular housing.

3. A fluid actuating mechanism according to claim 1 in which:

said inner tubular member includes a plurality of equally spaced longitudinally extending splines and grooves on the external surface thereof, said outer tubular member includes a plurality of equally spaced longitudinally extending splines and grooves in the inner surface thereof, the splines on each tubular member being of a size and shape fitting the grooves on the other tubular member, and said splines and grooves being operable to permit longitudinal movement of said tubular members while preventing relative rotational movement therebetween.

4. A fluid actuating mechanism according to claim 1 in which:

said tubular members include first cooperating hammer means and anvil means engagable with an impact force in one direction after a second predetermined relative movement of said tubular members in one direction, and second cooperating hammer means and anvil means engagable with an impact force in the opposite direction after a second predetermined relative movement of said tubular members in said opposite direction.

5. A fluid actuating mechanism according to claim 4 in which:

said fluid flow permitting means comprises valve means operable upon said first predetermined relative movement of said tubular members to release fluid from said chamber.

6. A fluid actuating mechanism according to claim 5 in which:

one of said tubular members includes a valve opening positioned between said first and said second piston means, and said valve means being positioned to control said valve opening to release fluid from the space between said piston means.

7. A fluid actuating mechanism according to claim 6 in which:

said piston relative movement permitting means comprises means providing a relatively minute flow of fluid from said chamber upon said relative movement of said piston means.

8. A fluid actuating mechanism according to claim 7 in which:

said first and second piston means comprise a pair of annular piston members each surrounding said inner tubular member and fitting within said outer tubular member, and each piston member being movable relative to the other and relative to each of said tubular members.

9. A fluid actuating mechanism according to claim 8 in which:

said valve means comprises a two-part valve member and spring means cooperable therewith urging the parts thereof into closing engagement one with the other.

10. A fluid actuating mechanism according to claim 9 including:

first and second valve actuating means cooperable respectively with one of said valve parts and with the other valve part for separate and independent operation thereby upon said first predetermined relative movement of said tubular members.

11. A fluid actuating mechanism according to claim 8 in which:

said leakage flow means comprises an orifice opening in at least one of said piston members.

12. A fluid actuating mechanism according to claim 5 in which:

said valve means comprises a two-part valve member and resilient means cooperable therewith urging the parts thereof into closing engagement one with the other.

13. A fluid actuating mechanism according to claim 5 in which:

said valve means includes at least one of said piston means.

14. A fluid actuating mechanism according to claim 5 in which:

said valve means includes both of said piston means.

15. A fluid actuating mechanism according to claim 1 in which:

said means for moving said first and said second piston means comprises abutment means on one of said tubular members engageable therewith.

16. A fluid actuating mechanism according to claim 1 comprising a double acting hydraulic jar for connection in a tubular earth drilling string including:

means including said tubular members and seal means cooperable therewith defining a fluid-containing outer chamber therebetween, said first and said second piston means being positioned in spaced relation for movement longitudinally in said outer chamber and spaced apart to define an inner chamber within said outer chamber, said outer and inner chambers being adapted to be filled with a hydraulic fluid resisting relative movement of said piston means toward each other, at least one passageway opening from a point intermediate said piston means for flow of fluid from said inner chamber to said outer chamber, valve means in said inner chamber closing said opening to said passageway, and valve actuating means operable upon predetermined relative movement of said tubular members in either direction to open said valve means to permit flow of fluid from said inner to said outer chamber to reduce substantially the resistance to relative movement of said tubular members.

17. A double acting hydraulic jar for connection in a tubular earth drilling string comprising:

outer and inner tubular members positioned in telescoping relation for limited longitudinal movement of one relative to the other, means including said tubular members and seal means cooperable therewith defining a fluid-containing outer chamber therebetween, first and second piston means positioned in spaced relation for movement longitudinally in said outer chamber and spaced apart to define an inner chamber within said outer chamber, means for moving said first piston means toward said second piston means in response to relative movement of said tubular members in one direction, means for moving said second piston means toward said first piston means in response to relative movement of said tubular members in the opposite direction, said outer and inner chambers being adapted to be filled with a hydraulic fluid resisting relative movement of said piston means toward each other, means permitting relative movement between said piston means when said chambers are filled with fluid, at least one passageway opening from a point intermediate said piston means for flow of fluid from said inner chamber .o said outer chamber, valve means in said inner chamber closing said opening to said passageway, and valve actuating means operable upon predetermined relative movement of said tubular members in either direction to open said valve means to permit flow of fluid from said inner to said outer chamber to reduce substantially the resistance to relative movement of said tubular members.

18. A hydraulic jar according to claim 17 in which:

said inner tubular member includes a plurality of equally spaced longitudinally extending splines and grooves on the external surface thereof, said outer tubular member includes a plurality of equally spaced longitudinally extending splines and grooves in the inner surface thereof, the splines on each tubular member being of a size and shape fitting the grooves on the other tubular member, and said splines and grooves being operable to permit longitudinal movement of said tubular members while preventing relative rotational movement therebetween.

19. A hydraulic jar according to claim 17 including:

a passageway extending from one end portion to the other end portion of said outer chamber, around said inner chamber, to permit fluid flow therebetween.

20. A hydraulic jar according to claim 17 in which:

said tubular members comprise an inner tubular mandrel and an outer tubular housing member and include first cooperating hammer means and anvil means engagable with an impact force in one direction after said predetermined relative movement of said mandrel and said housing member in one direction, and second cooperating hammer means and anvil means engagable with an impact force in the opposite direction after said predetermined relative movement of said mandrel and said housing member in said opposite direction.

21. A hydraulic jar according to claim 17 in which:

said means permitting relative movement of said piston means comprises means providing a relatively minute flow of fluid from said inner to said outer chamber upon said relative movement of one of said piston means toward said other piston means.

22. A hydraulic jar according to claim 17 in which:

said valve means comprises a two-part valve member and spring means cooperable therewith urging the parts thereof into closing engagement one with the other.

23. A hydraulic jar according to claim 17 in which:

said first and second piston means comprise a pair of annular piston members each surrounding said inner tubular member and fitting within said outer tubular member, and each piston member being movable relative to the other and relative to each of said tubular members.

24. A hydraulic jar according to claim 23 in which:

said valve means comprises a two-part valve member and spring means cooperable therewith urging the parts thereof into closing engagement one with the other.

25. A hydraulic jar according to claim 21 in which:

said leakage flow means comprises a passageway in at least one of said piston members.

26. A hydraulic jar according to claim 24 including:

first and second valve actuating means comprising means interconnecting one piston member with one of said valve parts and the other piston member with the other valve part for separate and independent operation thereby.

27. A hydraulic jar according to claim 17 in which:

said tubular members include first cooperating hammer means and anvil means engagable with an impact force in one direction after a second predetermined relative movement in one direction, second cooperating hammer means and anvil means engagable with an impact force in the opposite direction after a second predetermined relative movement in said opposite direction, said first and second piston means comprise a pair of annular piston members each surrounding said inner tubular member and fitting within said outer tubular member, each piston member being movable relative to the other and relative to each of said tubular members, a passageway in at least one of said piston members providing a relatively minute flow of fluid from said inner to said outer chamber upon said relative movement of said piston members, said valve means comprising a two-part valve member held in closing engagement at least in part by fluid pressure in said chamber, spring means cooperable with said two-part valve member urging the parts thereof into closing engagement one with the other, and said valve actuating means comprise means interconnecting one piston member with one of said valve parts and the other piston member with the other valve part for separate and independent operation thereby.

28. A hydraulic jar according to claim 27 in which:

said means for moving said first and said second piston means comprises abutment means on one of said tubular members engageable therewith, said tubular member abutment means providing lost motion between said one tubular member and said piston means, and said valve actuating means providing lost motion between said piston means and the valve members actuated thereby.

29. A hydraulic jar comprising:

outer and inner tubular members positioned in telescoping relation for longitudinal movement of one relative to the other, said tubular members having spaced concentric walls defining a fluid-containing chamber therebetween, first and second piston means positioned in spaced relation for movement longitudinally in said chamber and being of a size and shape having a sliding fit between said concentric walls, at least one of said concentric walls having a portion intermediate said piston means concentric with and at a greater spacing from the other of said concentric walls, means for moving said first piston means toward said second piston means in response to relative movement of said tubular members in one direction, means for moving said second piston means toward said first piston means in response to relative movement of said tubular members in the opposite direction, said chamber being adapted to be filled with a hydraulic fluid resisting relative movement of said piston means toward each other, means permitting relative movement between said piston means when said chamber is filled with fluid, and each of said piston means being movable upon predetermined relative movement of said tubular means into said intermediate portion of greater spacing of said concentric walls thereby providing an opening for flow of hydraulic fluid from the space between said piston means.

30. A hydraulic jar according to claim 29 in which:

said inner tubular member includes a plurality of equally spaced longitudinally extending splines and grooves on the external surface thereof, said outer tubular member includes a plurality of equally spaced longitudinally extending splines and grooves in the inner surface thereof, the splines on each tubular member being of a size and shape fitting the grooves on the other tubular member, and said splines and grooves being operable to permit longitudinal movement of said tubular members while preventing relative rotational movement therebetween.

31. A hydraulic jar according to claim 29 in which:

said tubular members define an outer chamber therebetween, said piston means define an inner chamber positioned within said outer chamber, and a passageway is provided extending from one end portion to the other end portion of said outer chamber, around said inner chamber, to permit fluid flow therebetween.

32. A hydraulic jar according to claim 29 in which:

said tubular members include first cooperating hammer means and anvil means engagable with an impact force in one direction after a second predetermined relative movement in one direction, and second cooperating hammer means and anvil means engagable with an impact force in the opposite direction after a second predetermined relative movement in said opposite direction.

33. A hydraulic jar according to claim 29 in which:

said means for moving said first and said second piston means comprises abutment means on one of said tubular members engageable therewith, and said tubular member abutment means providing lost motion between said one tubular member and said piston means.

34. A hydraulic jar according to claim 33 in which:

said first and second piston means comprise a first and second annular piston member each surrounding said inner tubular member and fitting within said outer tubular member, said piston member relative motion permitting means comprising a loose fit by at least one piston member in said chamber between said concentric walls with sufficient clearance permitting a very small flow of hydraulic fluid past said piston member upon movement thereof by one of said abutment means, and each piston member having an annular seal in the face thereof engaging one of said abutment means while the other piston member is moved by the other of said abutment means.

35. A hydraulic jar according to claim 33 in which: one of said piston members has a passage therethrough with a check valve therein preventing flow of fluid therethrough upon movement of one of said piston members toward the other and permitting flow of fluid therethrough upon movement of one of said piston members away from the other.

* * * * *